US012667187B2

(12) United States Patent
Keck et al.

(10) Patent No.: US 12,667,187 B2
(45) Date of Patent: Jun. 30, 2026

(54) HOT ROLLED STORAGE RACK SYSTEMS AND METHODS

(71) Applicant: Steel King Industries, Inc., Stevens Point, WI (US)

(72) Inventors: Arlin Dennis Keck, Rome, GA (US); Amit Kutumbale, Plover, WI (US); Brian Ricard Pfannes, Stevens Point, WI (US); Steven James Peretz, Stevens Point, WI (US)

(73) Assignee: STEEL KING INDUSTRIES, INC., Stevens Point, WI (US)

( * ) Notice: Subject to any disclaimer, the term of this patent is extended or adjusted under 35 U.S.C. 154(b) by 0 days.

(21) Appl. No.: 18/908,301

(22) Filed: Oct. 7, 2024

(65) Prior Publication Data

US 2026/0096647 A1 Apr. 9, 2026

(51) Int. Cl.

| | |
|---|---|
| ***A47B 47/00*** | (2006.01) |
| ***A47B 47/02*** | (2006.01) |
| ***A47B 96/14*** | (2006.01) |
| ***B21B 1/08*** | (2006.01) |

(52) U.S. Cl.

CPC ..... *A47B 47/028* (2013.01); *A47B 96/14* (2013.01); *B21B 1/08* (2013.01)

(58) Field of Classification Search

CPC ..... A47B 47/028; A47B 96/14; A47B 87/02; A47B 87/0207; A47B 87/0246; A47B 87/0215; A47B 47/00; A47B 47/0083; A47B 47/021; A47B 47/027; A47B 57/00; A47B 57/06; A47B 57/18; A47B 57/30; A47B 57/44; B21B 1/08

See application file for complete search history.

(56) References Cited

U.S. PATENT DOCUMENTS 2,815,130 A * 12/1957 Franks ..... A47B 57/402 211/187
RE24,535 E * 9/1958 Franks ..... A47B 57/402 211/187
3,273,720 A * 9/1966 Seiz ..... A47B 57/402 108/107

(Continued)

OTHER PUBLICATIONS

BHD Racking Factory. BHD Storage Solutions. 5 pages. accessed Oct. 2, 2024.

(Continued)

*Primary Examiner* — Devin K Barnett
(74) *Attorney, Agent, or Firm* — Quarles & Brady, LLP

(57) ABSTRACT

A storage rack can include a first post having a first portion and a second portion secured via a splice assembly. The splice assembly can include a first plate on a first side of the first post, a first fastener arranged through the first plate and the first portion of the first post, and a second fastener arranged through the first plate and the second portion of the first post. The splice assembly can permit replacement of the first portion of the first post without replacement of the second portion of the first post. The storage rack can further include a second post, a bracket secured to the first post, and a brace assembly to secure the first post to the second post. The brace assembly can be arranged between the first post and the second post and secured to the first post via the bracket.

19 Claims, 25 Drawing Sheets

(56) References Cited

U.S. PATENT DOCUMENTS 3,391,795 A * 7/1968 Finlayson ..... A47B 57/50 248/243
3,465,898 A * 9/1969 Klein ..... A47B 87/0215 211/188
3,647,080 A * 3/1972 Denny ..... A47B 47/027 108/901
3,664,513 A * 5/1972 Atwater ..... B65G 1/02 52/653.1
3,788,242 A * 1/1974 Hassel ..... E04G 1/00 211/187
3,905,483 A * 9/1975 Patrick ..... F16M 11/22 211/26
D248,274 S * 6/1978 Kingston ..... D8/354
4,403,701 A * 9/1983 Corcoran ..... A47B 87/02 312/213
4,967,916 A * 11/1990 Handler ..... A47B 57/44 211/186
5,012,938 A * 5/1991 King ..... A47B 57/18 211/182
5,180,068 A * 1/1993 Vargo ..... F16B 12/10 403/231
5,425,520 A * 6/1995 Masumoto ..... A47B 96/06 403/231
5,918,750 A * 7/1999 Jackson ..... A47F 5/0807 108/108
6,216,893 B1 * 4/2001 Lee ..... B65G 1/02 211/189
6,298,537 B1 * 10/2001 Dion ..... A47B 96/00 29/402.06
6,604,640 B1 * 8/2003 Jehin ..... A47B 47/027 52/167.3
6,609,621 B2 * 8/2003 Denny ..... B65G 1/02 211/183
6,776,298 B2 * 8/2004 Courtwright ..... B65G 1/026 211/183
7,007,815 B2 * 3/2006 Anderson ..... A47B 47/027 211/183
7,191,907 B2 * 3/2007 Conway ..... B65G 1/02 182/138
7,255,237 B2 * 8/2007 Stitchick ..... A47B 96/028 403/392
7,497,054 B2 * 3/2009 Takeuchi ..... E04B 1/2403 403/403
7,753,220 B2 * 7/2010 Konstant ..... A47B 91/00 52/693
8,585,313 B2 * 11/2013 Wojotowicz ..... A47B 87/0215 248/300
9,456,688 B2 * 10/2016 Moyer ..... A47B 87/0276
9,961,995 B2 * 5/2018 Kam ..... A47B 47/028
10,858,185 B1 * 12/2020 Iellimo ..... B65G 1/04
11,028,586 B2 * 6/2021 Iellimo ..... B65G 1/02
11,064,806 B1 * 7/2021 Ge ..... A47B 87/0207
11,202,502 B1 * 12/2021 Berry ..... A47B 47/0083
D949,002 S * 4/2022 Parab ..... D8/394
11,629,007 B2 * 4/2023 Hadzic ..... A47B 96/1458 211/190
11,691,229 B2 * 7/2023 Klinger ..... B23P 19/041 211/183
12,011,087 B1 * 6/2024 Liu ..... A47B 47/028
12,342,932 B1 * 7/2025 Heaston ..... B65G 1/02
12,453,421 B1 * 10/2025 Berry ..... A47B 96/145
2007/0193190 A1 * 8/2007 Konstant ..... A47B 91/00 52/693
2009/0277854 A1 * 11/2009 Eustace ..... A47B 57/22 211/183
2012/0125872 A1 * 5/2012 Eustace ..... A47B 57/22 211/134
2012/0145657 A1 * 6/2012 Krummell ..... B65G 1/02 211/49.1
2015/0101998 A1 * 4/2015 Keck ..... A47B 47/028 211/49.1
2015/0129739 A1 * 5/2015 House ..... E04G 5/001 248/513
2018/0125231 A1 * 5/2018 Reyes ..... A47B 47/027
2020/0165064 A1 * 5/2020 Harrison ..... B65G 1/02
2023/0044061 A1 * 2/2023 Yoon ..... A47B 96/1441
2023/0270248 A1 * 8/2023 Hanlon ..... A47B 96/021
2024/0117831 A1 * 4/2024 Berry ..... A47B 87/0215
2024/0156253 A1 * 5/2024 French ..... A47B 87/0215
2024/0423360 A1 * 12/2024 Liu ..... A47B 47/0083

OTHER PUBLICATIONS

Nucor Warehouse Systems. a Revolution in Steel Pallet Rack Systems Tuberack. White Paper. 15 pages. Accessed Sep. 20, 2024 on https://nucorwarehousesystems.com.
Impossible Foods. Oakland, CA 94603. 252241 Drawing Index. 3 pages. accessed Sep. 23, 2021.

* cited by examiner

HOT ROLLED STORAGE RACK SYSTEMS AND METHODS

CROSS-REFERENCE TO RELATED APPLICATIONS

Not Applicable.

BACKGROUND

Storage rack systems may be used in a variety of storage environments (e.g., warehouses, distribution centers, etc.) to support the storage of products within the storage environment. However, current storage rack systems may require complex manufacturing processes, which may, for hot-rolled steel systems, require welding the storage rack system prior to transporting the storage racking to its final destination. Thus, transport of the final storage rack system may prove difficult and costly. Further, current storage rack systems may be difficult to maintain (e.g., perform maintenance on) due to the welded arrangement, which makes removal and reinstallation of various components of the storage rack system difficult and time-consuming.

SUMMARY

In some aspects, a storage rack can include a first post having a first portion and a second portion secured via a splice assembly. The splice assembly can include a first plate on a first side of the first post, a first fastener arranged through the first plate and the first portion of the first post, and a second fastener arranged through the first plate and the second portion of the first post. The splice assembly can permit replacement of the first portion of the first post without replacement of the second portion of the first post. The storage rack can further include a second post, a bracket secured to the first post, and a brace assembly to secure the first post to the second post. The brace assembly can be arranged between the first post and the second post and secured to the first post via the bracket.

In some aspects, a method of performing maintenance on a hot rolled storage rack can include removing a first plate of a splice assembly from a first hot rolled post of the storage rack, the splice assembly including the first plate arranged on a first side of the first hot rolled post of the storage rack and a reinforcement post arranged on a second side of the first hot rolled post, removing a first portion of the first hot rolled post of the storage rack, the first hot rolled post including the first portion and a second portion stacked on top of the first portion, the first portion and the second portion of the first hot rolled post secured together via the splice assembly, installing a replacement first portion of the first hot rolled post of the storage rack, and reinstalling the first plate of the splice assembly on the first side of the first hot rolled post with the first hot rolled post sandwiched between the first plate and a reinforcement post of the splice assembly.

In some aspects, a hot rolled storage rack can include a first hot rolled post having a first portion and a second portion arranged on top of the first portion, a reinforcement post forming a double-thickness portion extending from a first end of the first portion of the hot rolled post past a separation between the first portion and the second portion of the hot rolled post, a splice assembly to permit replacement of the first portion of the first hot rolled post without replacement of the second portion of the first hot rolled post, a second hot rolled post, a bracket secured to the first hot rolled post, and a brace assembly to secure the first hot rolled post to the second hot rolled post. The brace assembly can be arranged between the first hot rolled post and the second hot rolled post and secured to the first hot rolled post via the bracket.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Figure 1:
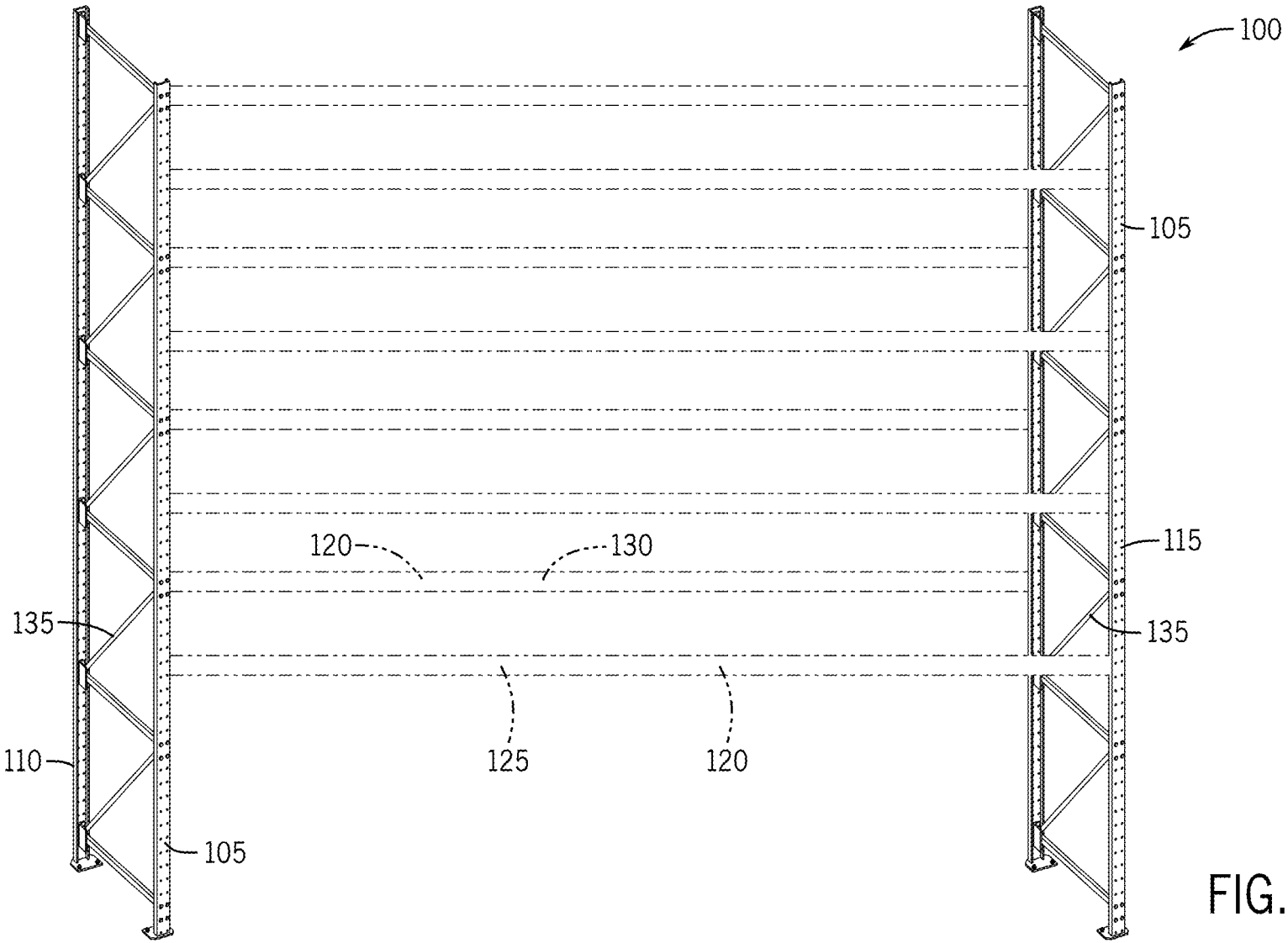
FIG. 1 is an axonometric view of a bay of a storage rack according to aspects of the present disclosure.

The following discussion is presented to enable a person skilled in the art to make and use embodiments of the invention. Given the benefit of this disclosure, various modifications to the illustrated embodiments will be readily apparent to those skilled in the art, and the principles herein can be applied to other embodiments and applications without departing from embodiments of the invention. Thus, embodiments of the invention are not intended to be limited to embodiments shown, but are to be accorded the widest scope consistent with the principles and features disclosed herein.

The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

As mentioned above, conventional storage racks (e.g., upright frames) may be manufactured from a series of welded components (e.g., posts, braces, base plates, etc.), which may make transport or maintenance of the storage racks inefficient. For example, if a portion of a storage rack is damaged, the damaged portion may need to be cut out and removed from the storage rack, which may increase the risk of damage to the storage rack.

Examples of the present disclosure can address these problems, for example, by providing a modular hot rolled storage rack (e.g., a field assembles or "knock-down" storage rack) with components removably secured together via brackets and fasteners. For example, the storage rack may include one or more brackets, which may be secured to one or more posts of the storage rack. The brackets may be removably secured to the posts via one or more braces (e.g., forming a brace assembly of the storage rack). Thus, an upright of the storage rack may be formed. In some examples, the brackets may include two separate L-shaped portions together forming a T-shaped bracket.

In some examples, the storage rack may include a splice assembly (e.g., a splice joint), the splice assembly may permit the removal and replacement of a portion of the post of the storage rack, without the need to cut or field weld the storage rack. Thus, on-site replacement of a portion of the post may be facilitated. Further, to mitigate the risk of damage to the posts of the storage rack, the storage rack may include an offset front leg, which mitigate the risk of contact between the front leg of the storage rack and a material handling vehicle (e.g., a forklift, pallet jack, etc.).

FIG. 1 illustrates one example of a storage rack 100. In some examples, the storage rack 100 may be made from hot rolled structural steel (e.g., structural steel channels of various depths). However, in other examples, the storage rack 100 may be made from alternative metal or metallic materials (e.g., cold rolled steel, metal tubing, etc.). The storage rack 100 may include one or more uprights 105, which may be separated by one or more crossmembers (e.g., shelf beams) 120. For example, the storage rack 100 may include a first upright 110 and a second upright 115, which may be separated by one or more first crossmembers 125 and one or more second crossmembers 130. The first crossmembers 125 and the second crossmembers 130 may form a load shelf configured to receive products (e.g., pallets, storage containers, etc.) for storage on the storage rack 100. In some examples, the storage rack 100 may include a series of vertically (with respect to the ground) stacked load shelves formed by the first crossmembers 125 and the second crossmembers 130, which may facilitate the vertical loading of products on the storage rack 100. As should be appreciated, the dimensions of the storage rack 100 (e.g., the height, width, length) may be adjusted based on the sizing of the uprights 105 and the crossmembers 120. Thus, the overall size of the storage rack 100 may be designed to meet the needs of a user (or the space constraints of a warehouse, etc.).

Figure 2:
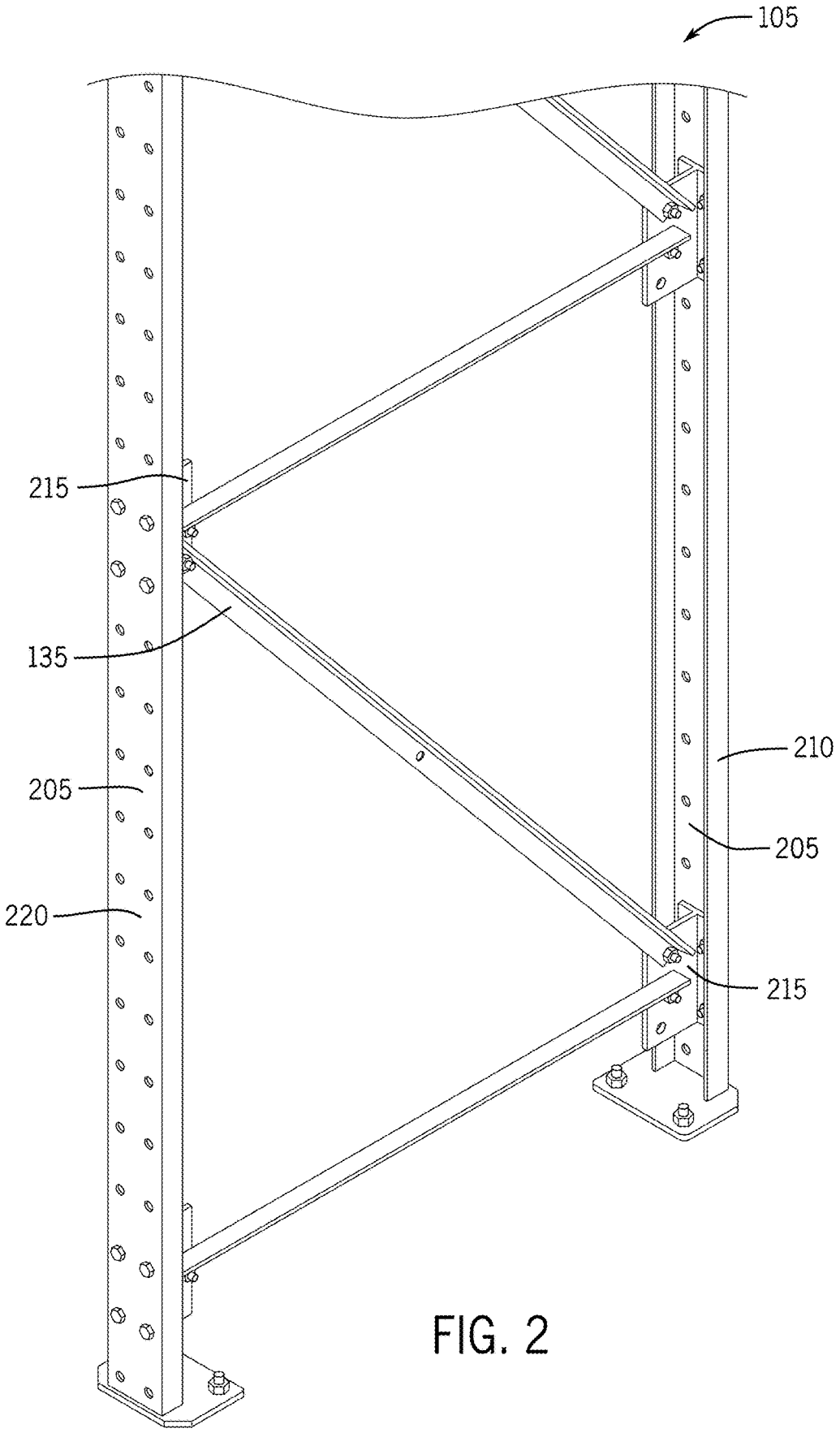
FIG. 2 is an axonometric view of a portion of the storage rack of FIG. 1.
Figure 3:
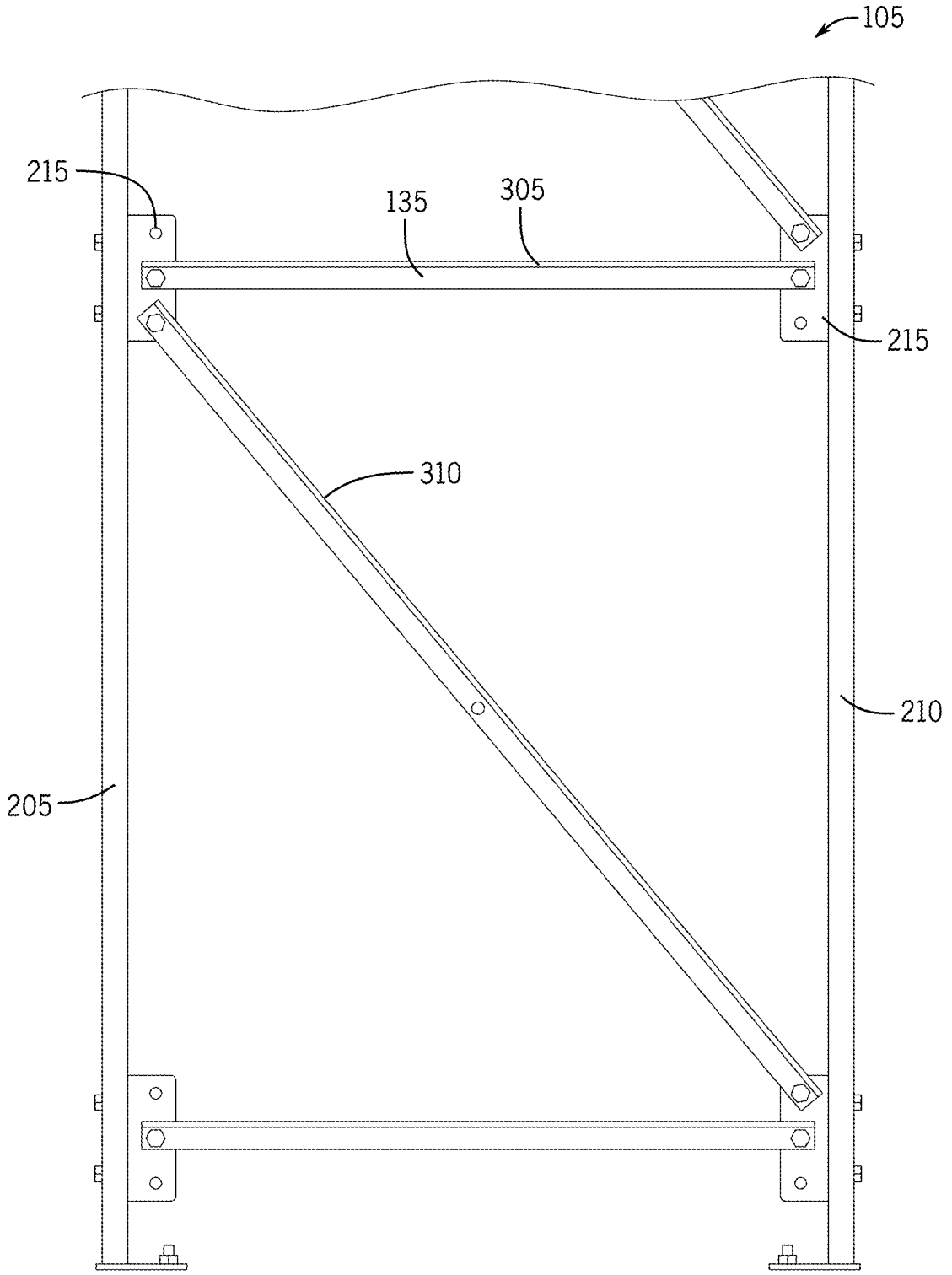
FIG. 3 is a side view of a portion of the storage rack of FIG. 1.

In some examples, in order to provide additional (e.g., cross-aisle direction) structural support to the storage rack 100, the uprights 105 may include a brace assembly (e.g., brace members) 135. The brace assembly 135 may act to secure portions of the uprights 105 together to form the uprights 105. For example, as shown in FIGS. 2 and 3, the uprights 105 may include one or more support post 205, which may be secured together via the brace assembly 135. For example, the uprights 105 may include a first support post 210 and a second support post 220, which may be secured together via one or more horizontal braces 305 and one or more angled braces (e.g., diagonals) 310 of the brace assembly 135. Further, based on the dimensions of the horizontal braces 305 and the angled braces 310 (e.g., length) the distance between the first support post 210 and the second support post 220, and thus the depth of the uprights 105 may be determined.

In some examples, in order to secure the brace assembly 135 (e.g., the horizontal braces 305 and the angled braces 310) to the support post 205, the uprights 105 may include one or more mounting brackets 215. The mounting brackets 215 may be removably secured to the support posts 205, and the brace assembly 135 may in turn be removably secured to the mounting brackets 215. Thus, a modular arrangement of the storage rack 100 may be facilitated, which permits the insertion and removal of components of the storage rack 100 (e.g., the support posts 205, mounting brackets 215, brace assembly 135, etc.), without having to break welds, cut, or otherwise damage the storage rack 100.

Figure 4:
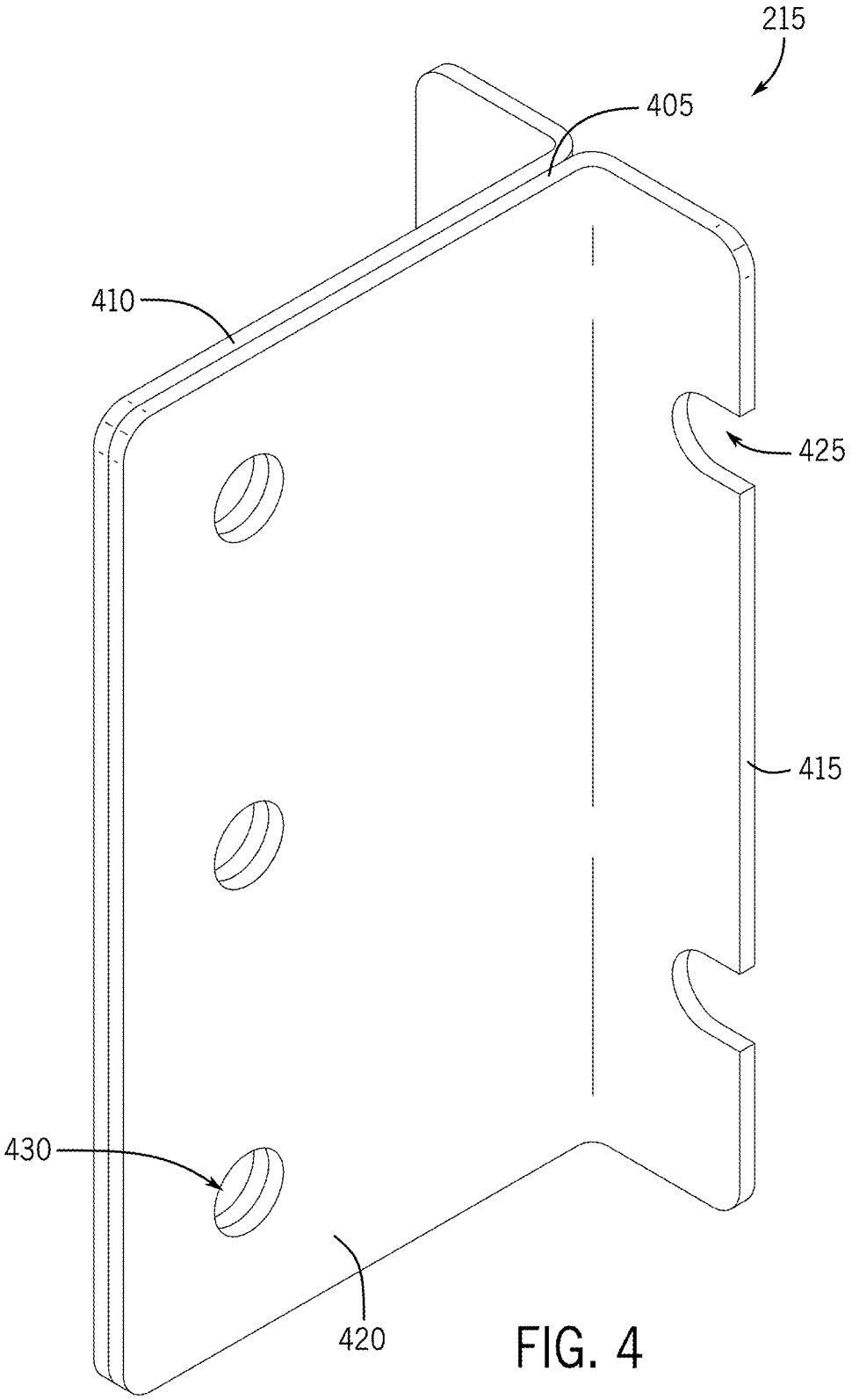
FIG. 4 is an axonometric view of a bracket for use with the storage rack of FIG. 1.

Turning to FIG. 4, an example of one of the mounting brackets 215 is shown. The mounting bracket 215 may include a pair of separate L-shaped portions (e.g., L-shaped angles), which may be removably secured together via the arrangement of a fastener through one or more thru-holes 430 arranged through each of the L-shaped portions. For example, the mounting bracket 215 may include a first portion 405 (e.g., first L-shaped portion, right-hand angle) including a first flange 415 and a second flange 420 extending from the first flange 415 (e.g., defining the L-shape). In some examples, the first flange 415 may mount against an inside of the hot-rolled upright post 205, while the second flange 420 may project perpendicularly from the upright post towards an opposing upright post. Further, the second flange 420 may be used to mount the brace member 135. In some examples, the first flange 415 may include one or more cutouts 425, which may be configured to receive a fastener in order to secure the mounting bracket 215 to the support post 205. Correspondingly, the second flange 420 may include one or more thru-holes 430, which may be configured to receive a fastener to secure the first portion 405 to a second portion 410 (e.g., a second L-shaped portion, left-hand angle), and secure the brace assembly 135 to the mounting bracket 215 (and thus the support post 205). Further, as should be appreciated, the first portion 405 and the second portion 410 may be substantially similar such that the second portion 410 includes the first flange 415 and the second flange 420 described above with respect to the first portion 405.

In some examples, the second flange 420 of the first and second portions 405, 410 may be arranged side-by-side (e.g., with the second flange 420 of the first portion 405 and the second flange 420 of the second portion 410 contacting), so that the thru-holes 430 of the first portion 405 and the thru-holes 430 of the second portion 410 align and permit the installation of a fastener through the thru-holes 430. In some examples, rather than have the mounting bracket 215 designed as a multi-piece bracket, the mounting bracket 215 may be designed with the first portion 405 and the second portion 410 secured together, thus forming a one-piece bracket, defining a T-shape.

Figure 5:
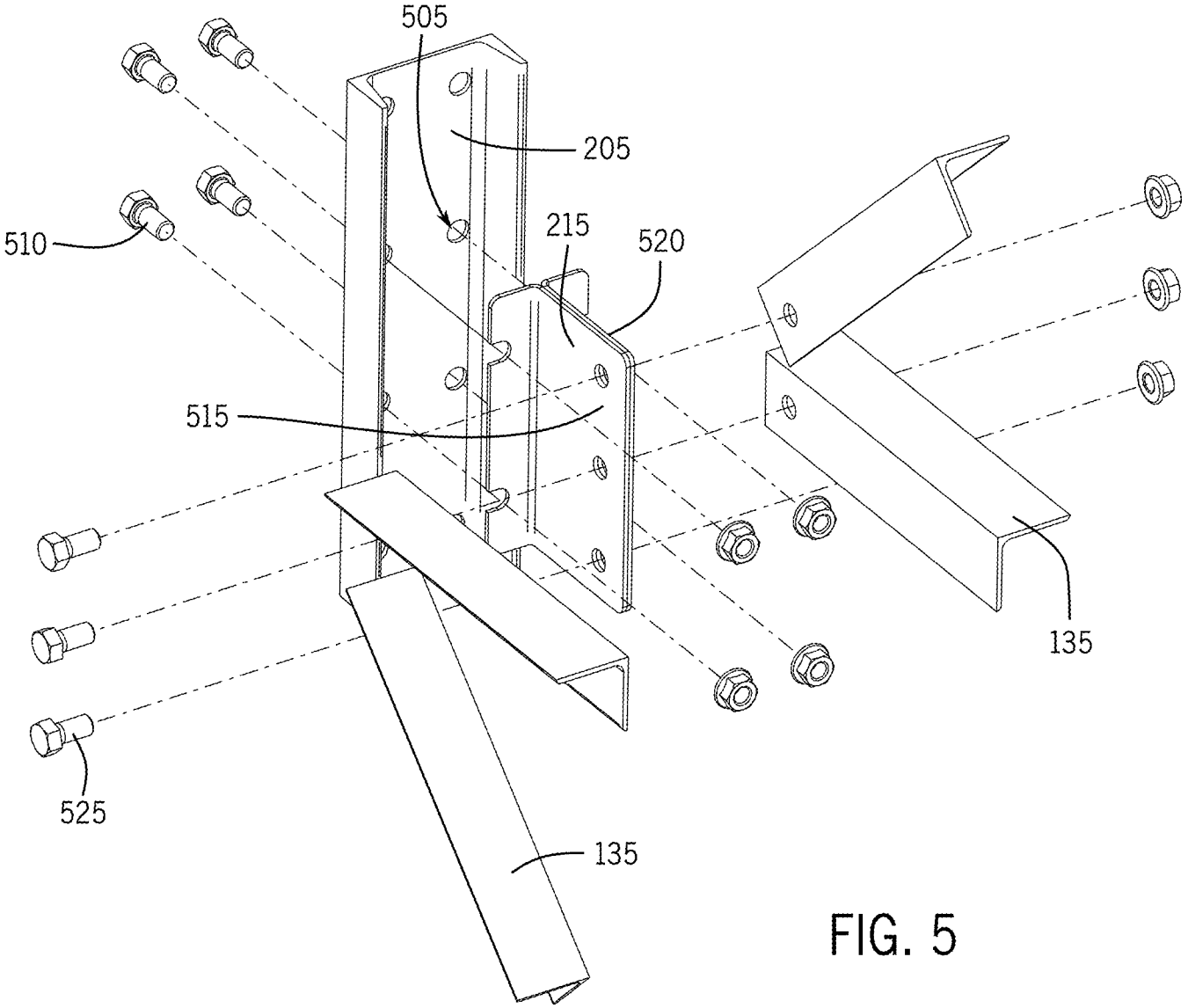
FIG. 5 is an exploded view of a portion of the storage rack of FIG. 1 including the bracket of FIG. 4.

An example installation process of the mounting bracket 215 and the brace assembly 135 will be described with respect to the example shown in FIG. 5. For example, during installation of the mounting bracket 215, one or more fasteners 510 (e.g., screws, bolts, nuts, rivets, or any other known fastener) may be arranged though one or more apertures 505 arranged along the support post 205. Following this, the mounting bracket 215 may be aligned with the apertures 505 and arranged with a portion of the fasteners 510 arranged through the cutouts 425 of the first flange 415. As should be appreciated, the design of the cutouts 425 permits adjustment of the mounting bracket 215 with respect to the fasteners 510 in order to facilitate fitment of the mounting bracket 215. In some examples, once the mounting bracket 215 is arranged with the fasteners 510 through the cutouts 425, the mounting bracket 215 may be fastened to the support post 205 via the fasteners 510.

In some examples, once the mounting bracket 215 is secured to the support post 205, the brace assembly 135 may be secured to the second flange 420 of the mounting bracket 215 via the thru-holes 430. For example, the brace assembly 135 may be arranged so that an opening in the brace assembly 135 is aligned with the thru-holes 430 of the mounting bracket 215. Following this, one or more fasteners 525 may be arranged through the brace assembly 135 and the thru-holes 430 and tightened to secure the brace assembly 135 to the mounting bracket 215. As shown, in some examples, the brace assembly 135 may be secured to a first side 515 of the mounting bracket 215, a second side 520 of the mounting bracket 215, or both the first side 515 and the second side 520 of the mounting bracket 215 depending on the needs of a user. Further, due to the arrangement of the thru-holes 430 on the mounting bracket 215, the brace assembly 135 may be arranged at a variety of angles with respect to the mounting bracket 215 (e.g., perpendicular to the support post 205, or at an upward or downward angle with respect to the support post 205). Additionally, due to the number of thru-holes 430 for the mounting bracket 215, a series of components of the brace assembly 135 may be arranged on a single mounting bracket 215 (e.g., horizontal and angled braces). As mentioned previously, the mounting bracket 215 facilitates the modular arrangement of the storage rack 100, with the mounting brackets 215 and the brace assembly 135 able to be removed, replaced, or installed without cutting or otherwise damaging the storage rack 100.

Figure 6:
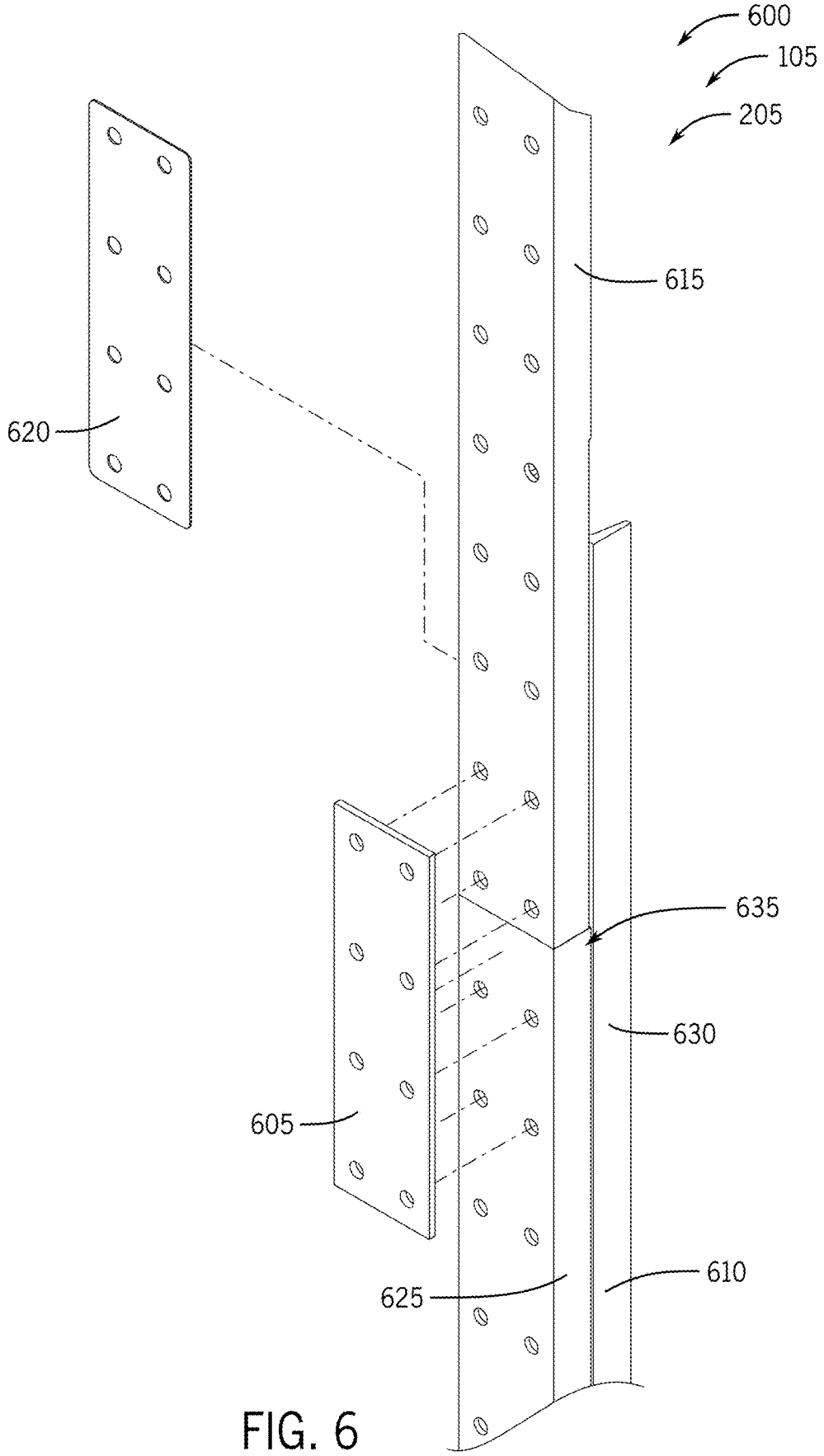
FIG. 6 is an axonometric view of a portion of a splice assembly of the storage rack of FIG. 1.
Figure 7:
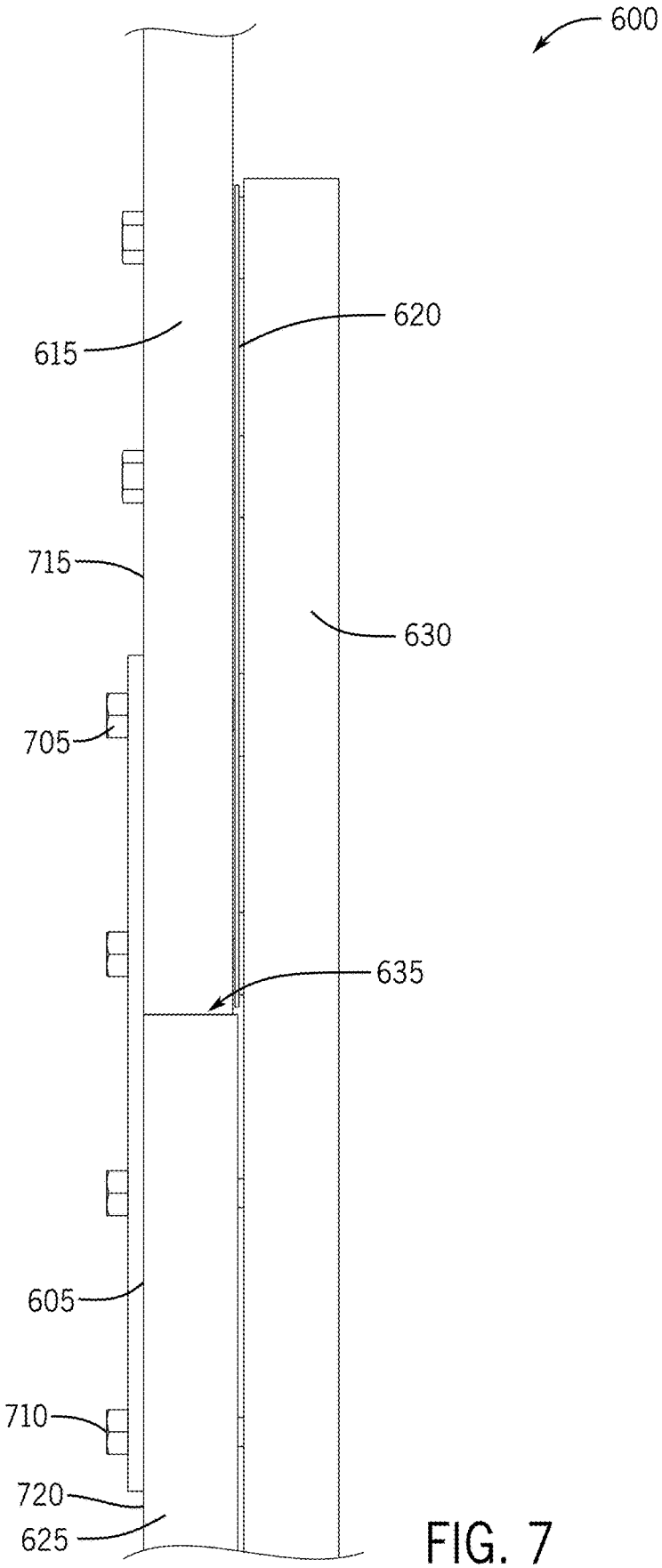
FIG. 7 is a side view of the portion of the splice assembly of FIG. 6.

FIGS. 6 and 7 show an example of a splice assembly 600 of the storage rack 100. In some examples, the splice assembly 600 of the storage rack 100 permits the removal and installation of a portion (e.g., a damaged section) of the support post 205 onsite (e.g., in the warehouse), without needing to cut or otherwise damage the storage rack 100, which may increase efficiency, reduce overall maintenance costs, avoid quality issues, reduce lost storage space, etc. In some examples, the splice assembly 600 may include a mounting (e.g., exterior) plate 605 and a removable post assembly (e.g., a removable lower portion of the upright post) 610. The post assembly 610 may be formed as a double-thick portion of the support post 205 including a first leg (e.g., an upright channel post) 625 and a reinforcement post 630. Put differently, the support post 205 may include a post assembly 610 and a second leg 615. The post assembly 610 may include the first leg 625 and the reinforcement post 630, with the second leg 615 arranged on top of (e.g., stacked) on the first leg 625. Further, the reinforcement post 630 may extend along the second leg 615, past a splice 635 of the support post 205 (e.g., where the first leg 625 and the second leg 615 meet). In some examples, the reinforcement post 630 may extend at least 3 inches past the splice 635 of the support post 205. In one particular example, the reinforcement post 630 may extend about 14 inches past the splice joint 635. In some examples, in order to facilitate the alignment of the second leg 615 and the first leg 625, the splice assembly 600 may include a shim plate 620, which may be arranged between the reinforcement post 630 and the second leg 615 to account for variation within the width of one or more channel flanges.

In some examples, in order to secure the post assembly 610 and the second leg 615 together (e.g., to form the full-height support post 205), the mounting plate 605 may be arranged on (e.g., in contact with) a face 715 of the second leg 615 and a face 720 of the first leg 625, with the mounting plate 605 overlapping the splice 635. Following this, one or more first fasteners 705 may be arranged though apertures in the mounting plate 605, second leg 615, and the reinforcement post 630, so that the second leg 615 is sandwiched between the mounting plate 605 and the reinforcement post 630. Correspondingly, one or more second fasteners 710 may be arranged though apertures in the mounting plate 605, first leg 625, and reinforcement post 630.

In some further examples, in order to replace a portion (e.g., a damaged section) of the support post 205 (e.g., the post assembly 610), the operator may first remove the first and second fasteners 705, 710. Following this, the operator may remove the mounting plate 605, while applying a force (e.g., via a material handling vehicle or otherwise) to the second leg 615 in order to maintain the second leg 615 in position (e.g., prevent falling of the second leg 615). Once the mounting plate 605 is removed, the operator may remove the entire post assembly 610 (e.g., with the post assembly 610 as a unitary assembly including the first leg 625 and the reinforcement post 630). The post assembly 610 may then be replaced with a new, undamaged post assembly 610. Once the new post assembly 610 is in position (e.g., with the second leg 615 aligned with the first leg 625 and abutting the reinforcement post 630), the mounting plate 605 may be reinstalled and secured in position via the first and second fasteners 705, 710. As should be appreciated, the above-referenced process may be completed without the need to cut or otherwise damage components of the storage rack 100.

In another example, the splice assembly 600 may include a shelf arranged between the first leg 625 and the second leg 615. In some examples, the shelf may be configured to contact the first leg 625 at a first end and to contact the second leg 615 at a second end. The shelf may be secured (e.g., welded or otherwise fastened) to and extend from the reinforcement post 630 (e.g., the shelf may be welded to a face of the reinforcement post 630). In some examples, the first fasteners 705 and the second fasteners 710 may be arranged on opposing sides of the shelf. Put differently, the shelf may serve as a support for ends of the first and second legs.

Figure 8A:
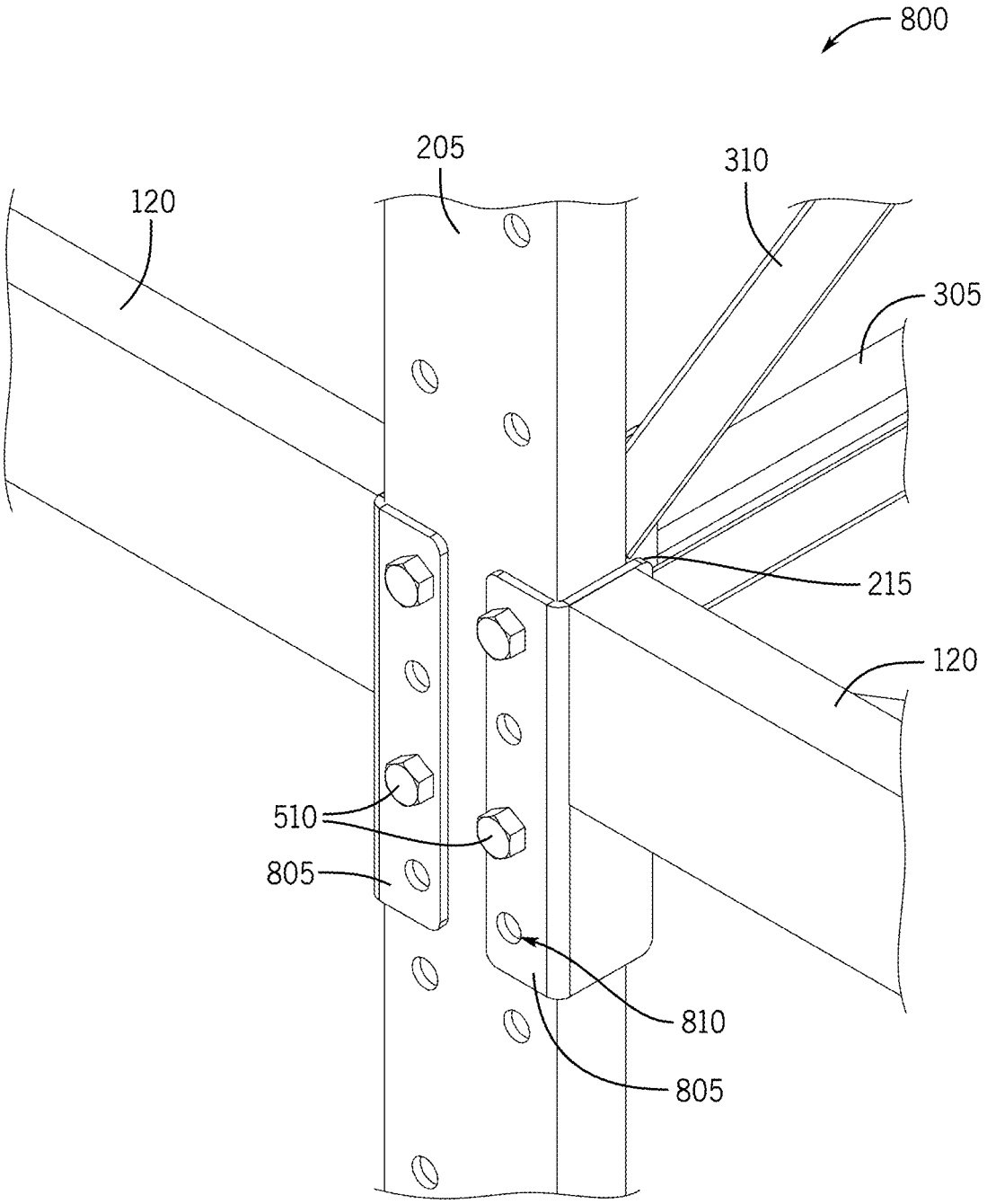
FIG. 8A is a first axonometric view of an example of a crossmember mounting system for use with the storage rack of FIG. 1.
Figure 8B:
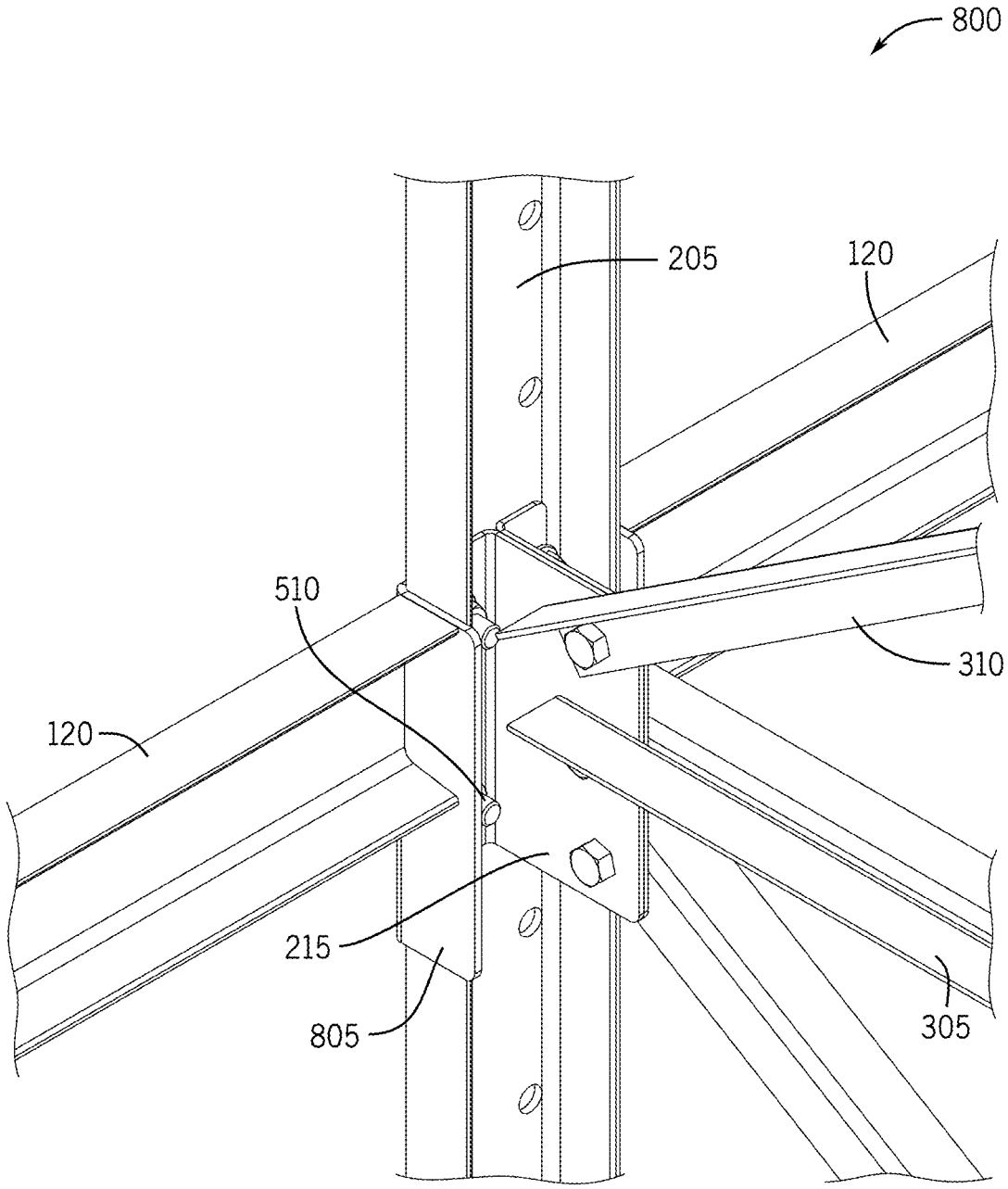
FIG. 8B is a second axonometric view of the crossmember mounting system of FIG. 8A.

FIGS. 8A and 8B show an example of a crossmember (e.g., shelf beam) mounting system 800. In some examples, the crossmember mounting system 800 permits the use of the fasteners 510 (e.g., fasteners used to secure the bracket 215) to secure the crossmembers 120 to the posts 205. In some examples, to install the crossmembers 120, the crossmember 120 may be arranged with a mounting flange 805 arranged in contact with the post 205. For example, the mounting flange 805 may include an L-shaped portion that wraps around a portion (e.g., a corner) of the post 205. Following this, an operator may align one or more apertures 810 of the mounting flange 805 with the one or more apertures of both the post 205 and the bracket 215. Thus, the operator may arrange the fastener through the mounting flange 805 of the crossmember 120, the post 205, and the bracket 215 in order to secure both the bracket 215 and the crossmember 120 to the post 205.

Figure 8C:
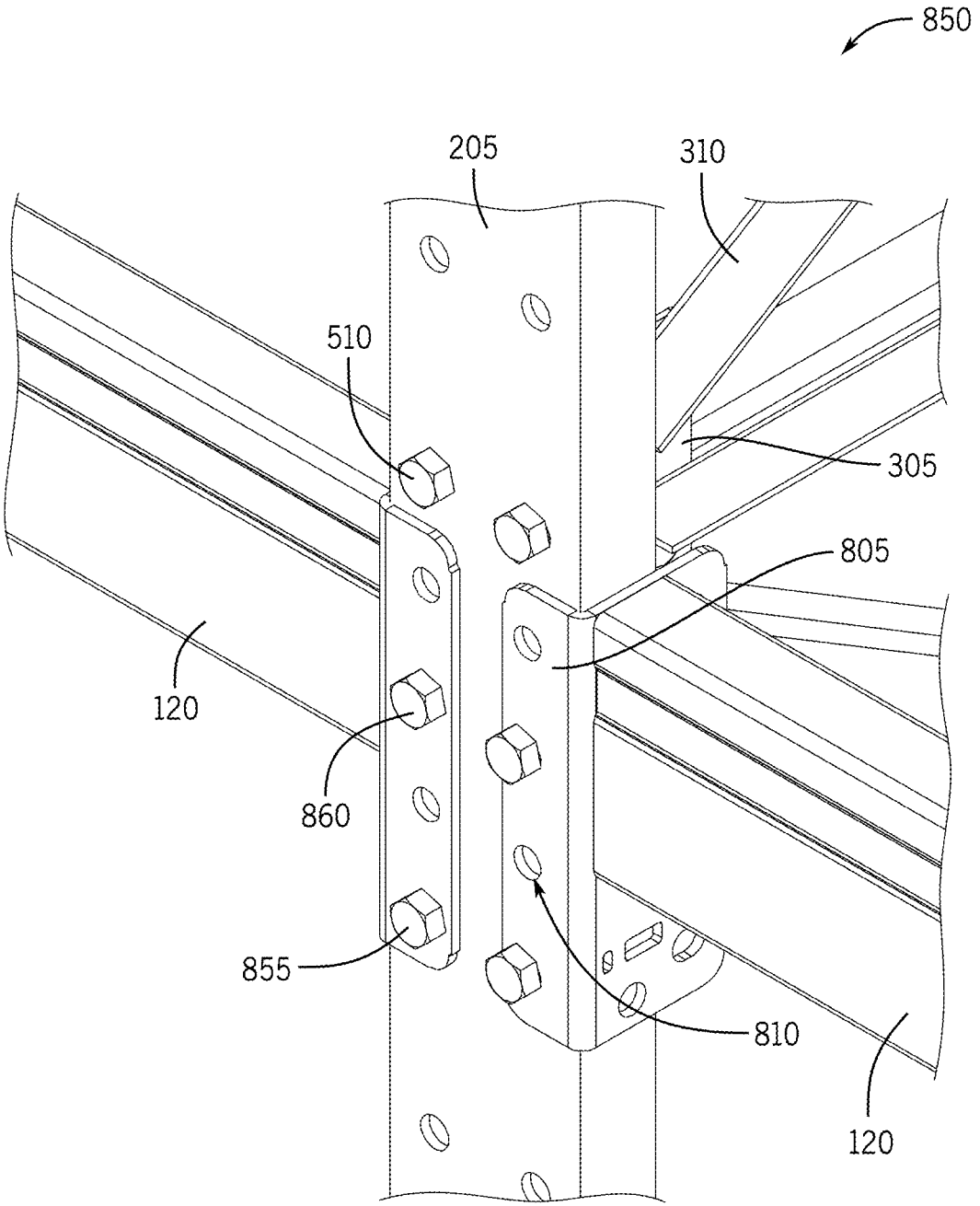
FIG. 8C is a first axonometric view of an example of an offset crossmember mounting system for use with the storage rack of FIG. 1.
Figure 8D:
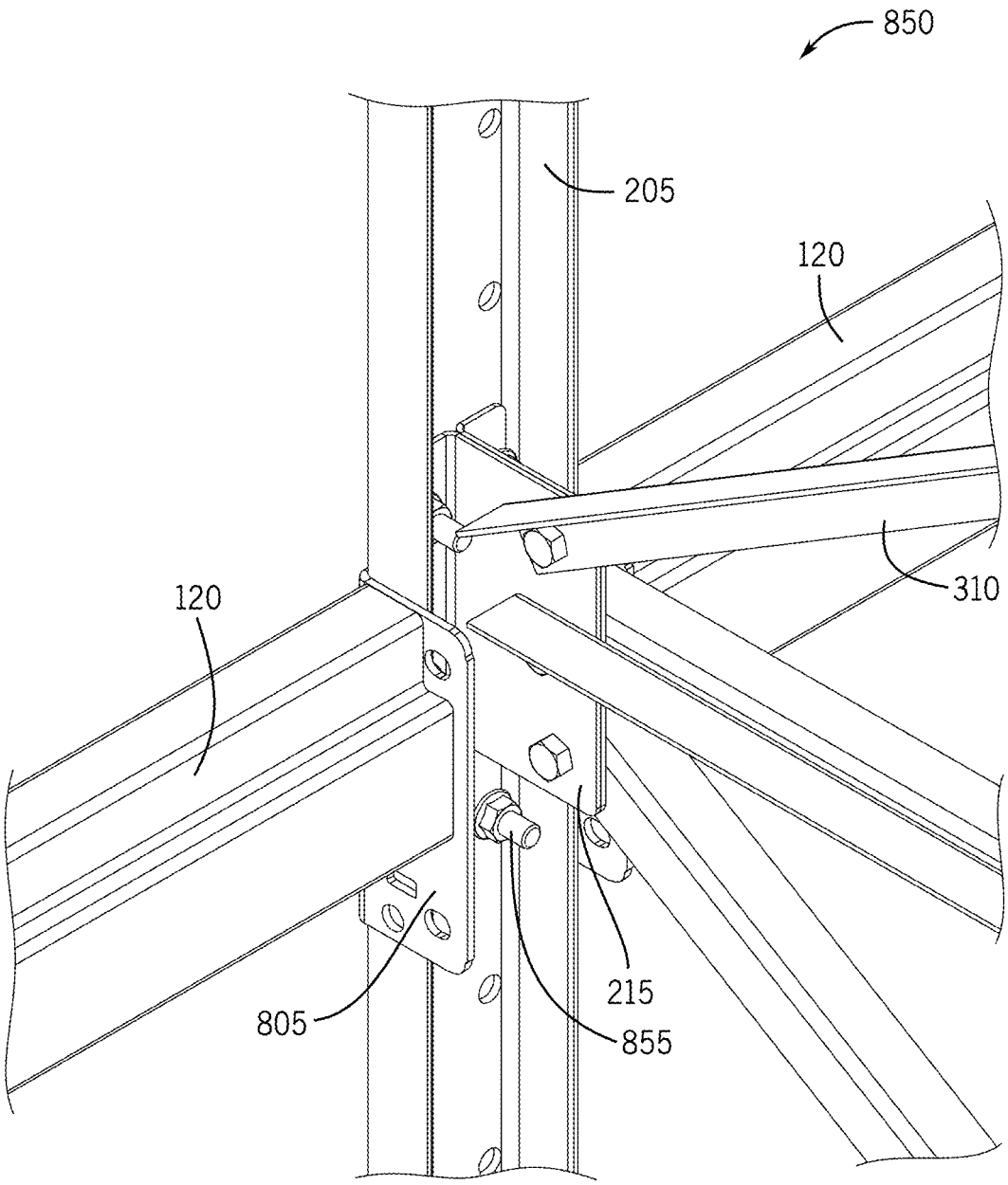
FIG. 8D is a second axonometric view of the crossmember mounting system of FIG. 8C.

FIGS. 8C and 8D illustrate another example of a crossmember (e.g., shelf beam) mounting system 850 that can be used with the storage rack 100 of FIG. 1 (e.g., as an alternative configuration of the crossmember mounting system 900). As will be recognized, the crossmember mounting system 850 shares a number of components in common with and operates in a similar fashion to the examples illustrated and described previously. For the sake of brevity, these common features will not be again described below in detail. Rather, previous discussion of commonly named or numbered features, unless otherwise indicated, also applies to example configurations of the crossmember mounting system 850.

In some examples, the crossmember mounting system 850 may be offset from the bracket 215, so that only a single fastener (e.g., fastener 860) is shared between the bracket 215 and the crossmember 120. Thus, the crossmember 120 may include a secondary fastener 855 that is secured directly through the mounting flange 805 and the post 205, but not the bracket 215. As should be appreciated, this arrangement permits the installation of the bracket 215 with the fastener 510 (e.g., to secure the bracket 215 to the post 205). Following this, the operator may install the crossmember 120 by aligning one of the apertures of the crossmember 120 with a portion of the bracket 215. The operator may then insert a fastener (e.g., fastener 860) through the crossmember (e.g., via the omitting flange 805), the post 205, and the bracket 215. Additionally, the operator may arrange a fastener (e.g., fastener 855) through the crossmember 120 and the post 205. Thus, the crossmember 120 and the bracket 215 may share a fastener (e.g., 860), with the crossmember 120 and the bracket 215 respectively having separate fasteners (e.g., fasteners 855 and 510, respectively).

Figure 9:
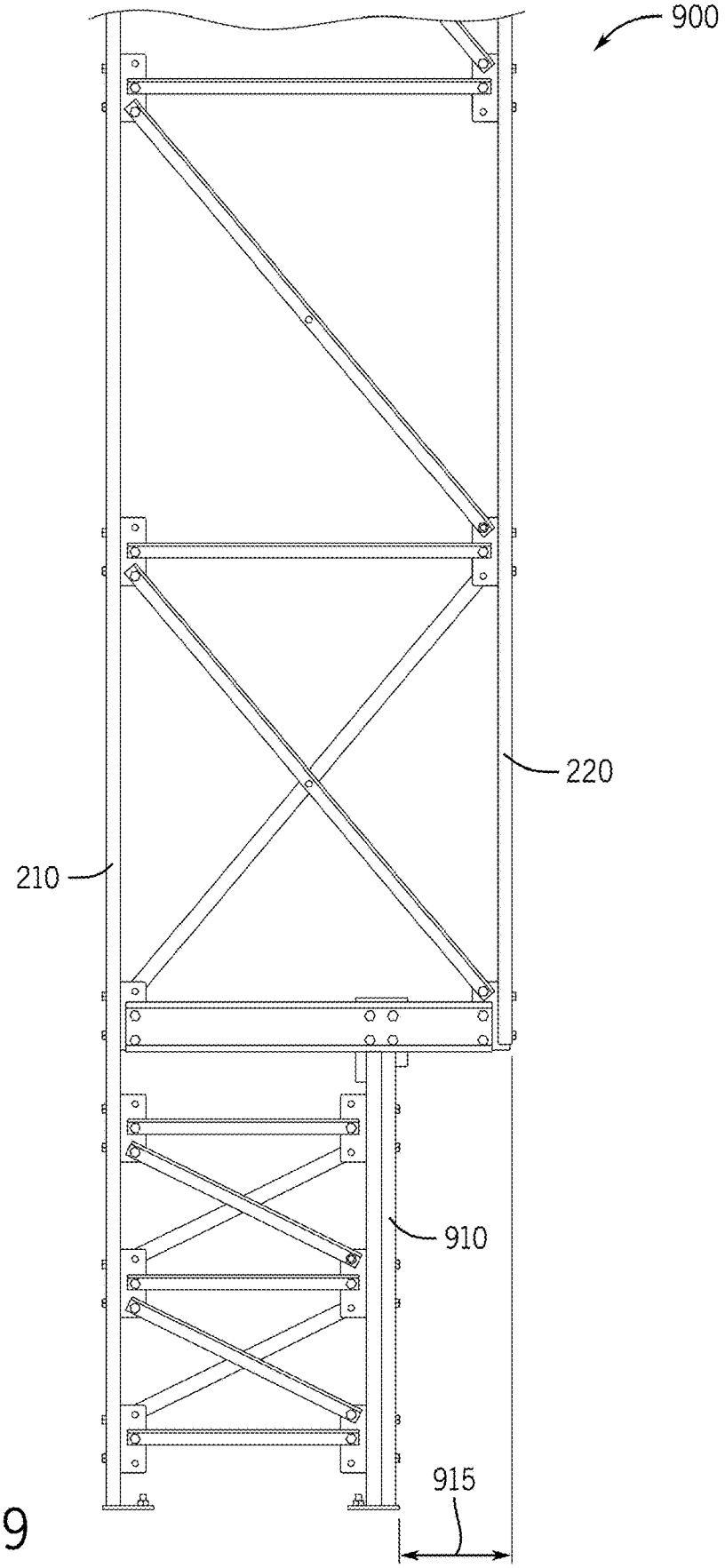
FIG. 9 is a side view of an offset leg assembly for use with the storage rack of FIG. 1.
Figure 10:
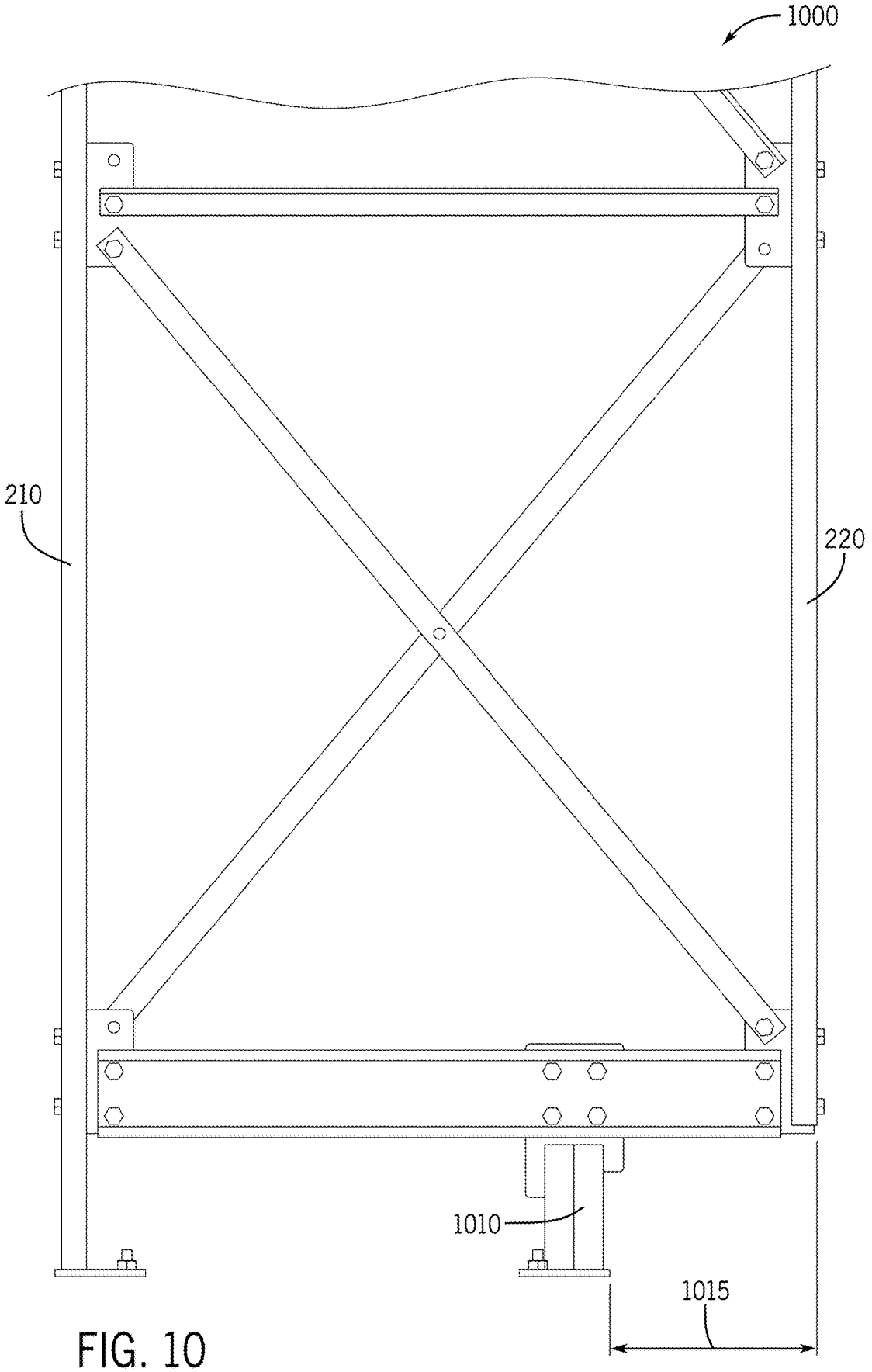
FIG. 10 is a side view of another example of an offset leg assembly for use with the storage rack of FIG. 1.

FIGS. 9 and 10 depict examples of offset leg assemblies for the storage rack 100. In some examples, the offset leg assemblies may be designed so that a portion of the support post 205 may be offset (e.g., recessed) to avoid contact between the support leg and a material handling vehicle (e.g., forklift, pallet truck, etc.), which may otherwise cause damage to a non-recessed front upright post of the storage rack 100.

As shown in FIG. 9, an offset leg assembly 900 may include a support leg 910 that is recessed from the second support post 220. For example, the support leg 910 may be recessed an offset distance 915 from the second support post 220 (e.g., towards the first support post 210) to mitigate the risk of contact with a material handling vehicle. Correspondingly, as shown in FIG. 10, an offset leg assembly 1000 may include a support leg 1010 that is recessed the same (or a different) distance offset distance 1015 from the second support post 220. However, as can be seen, a height of the offset leg assembly 900 and the offset leg assembly 1000 may be different, depending on the intended use case.

Figure 11:
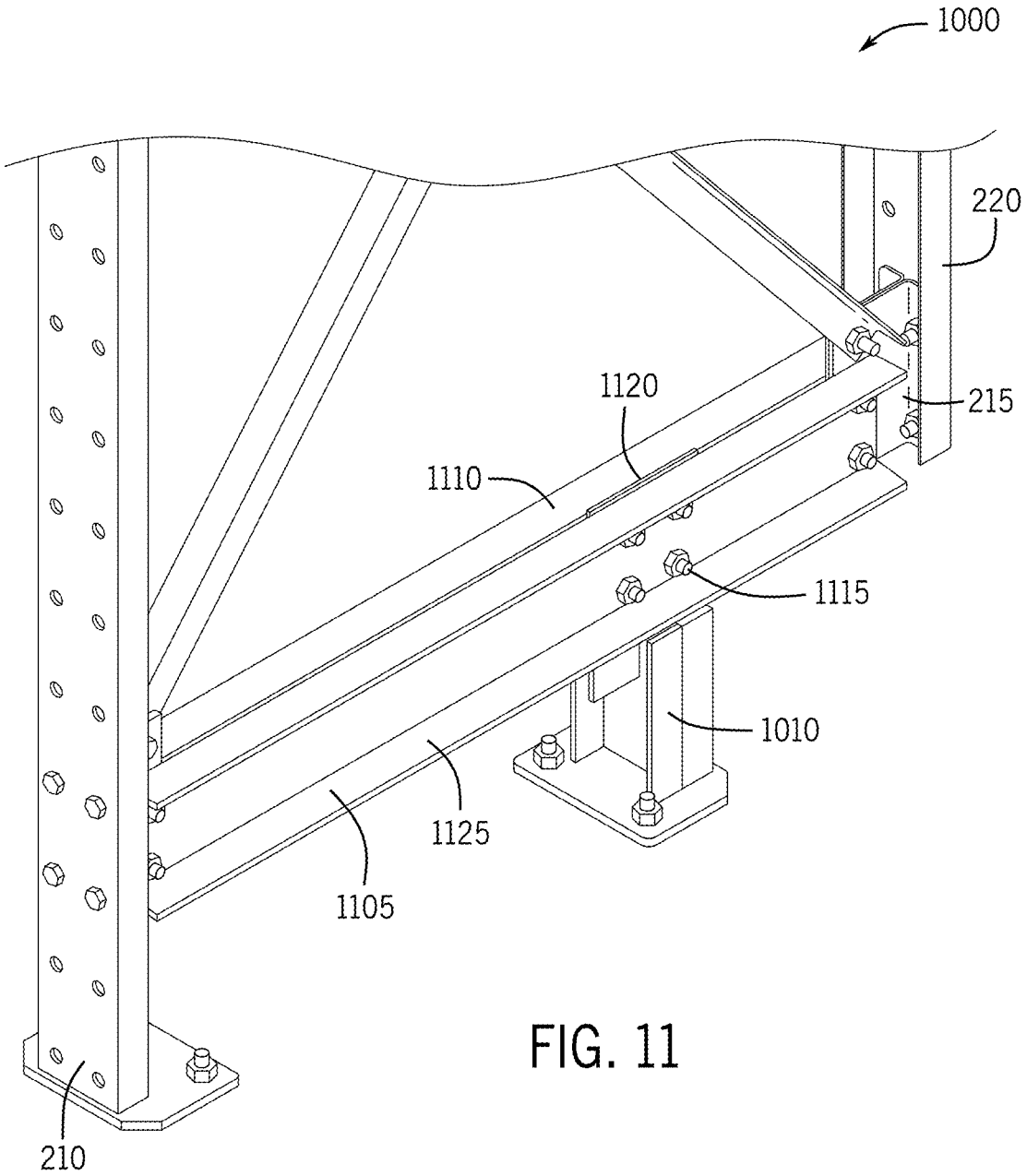
FIG. 11 is an axonometric view of the offset leg assembly of FIG. 10.
Figure 12:
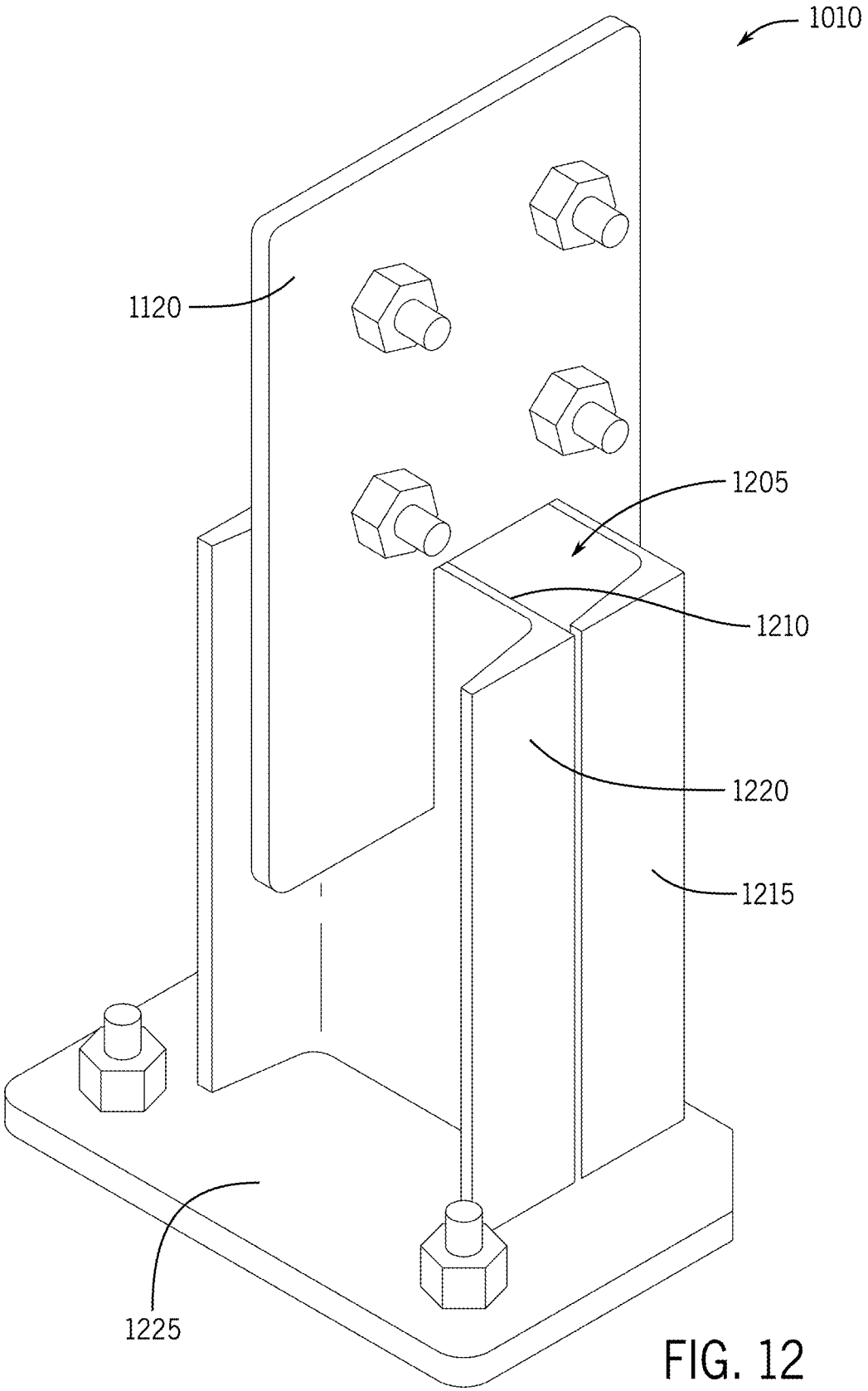
FIG. 12 is an axonometric view of a support leg for use with the offset leg assembly of FIG. 11.

Turning now to FIGS. 11 and 12, an example of the offset leg assembly 1000 is shown including components of the offset leg assembly 1000. As should be appreciated, while the arrangement of the offset leg assembly 1000 is being described and shown in FIGS. 11 and 12, similar components and arrangements are used with respect to the arrangement of the offset leg assembly 900. However, the height of the support leg 910 may be larger than the height of the support leg 1010.

In some examples, the offset leg assembly 1000 may include a strut (e.g., a heavy horizontal brace) 1105 having a first and second portions 1110, 1125, with a gusset 1120 of the support leg 1010 secured between the first and second portions 1110, 1125 of the strut 1105 via one or more fasteners 1115. In some examples, the strut 1105 may extend perpendicularly between the first and second support posts 210, 220. For example, the strut 1105 may be secured between the first and second support posts via the mounting brackets 215. In some examples, the position of the support leg 1010 (and thus the offset distance 1015) may be determined based on the position of the gusset 1120 between the first and second portions of the strut 1105. In some cases, rather than using both the first and second portions 1110, 1125 of the strut 1105, only one of the first portion 1110 or the second portion 1125 of the strut 1105 may be used.

In some examples, the support leg 1010 may include a first leg (e.g., a front post) 1215 and a second leg (e.g., a backer post) 1220 sandwiched together to form a double-thick (e.g., factory welded) assembly extending perpendicularly from a base 1225. Correspondingly, at an end 1210 of the first leg 1215 and the second leg 1220 may be the gusset 1120, which may be secured to both the first leg 1215 and the second leg 1220 via a cutout 1205, which may extend over and around the end 1210 of the first leg 1215 and the second leg 1220. In some examples, the gusset 1120 may secured to the first leg 1215 and the second leg 1220 so that the first leg 1215, second leg 1220, and the gusset 1120 form a unitary assembly. For example, the gusset 1120 may be welded to the first leg 1215 and the second leg 1220.

Figure 13:
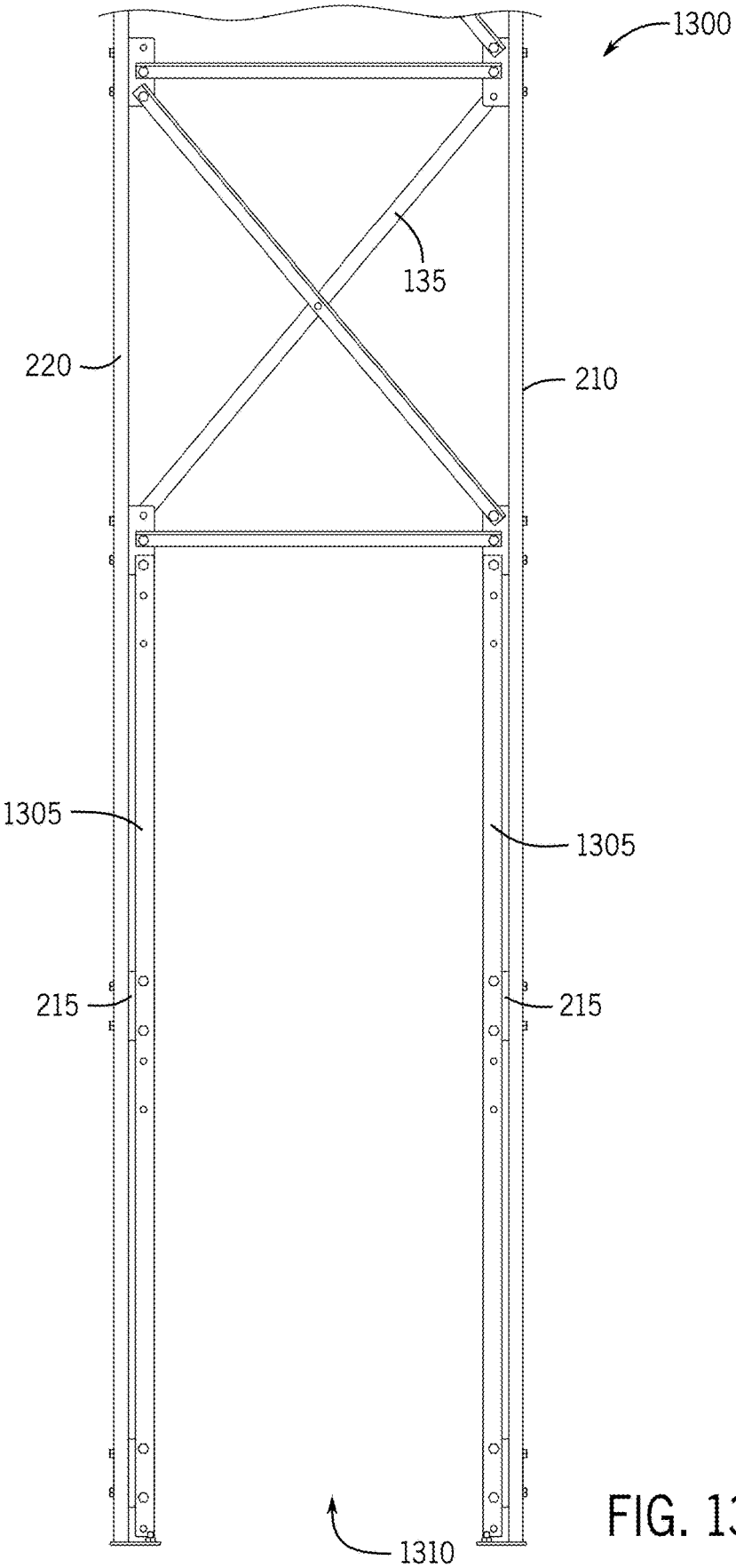
FIG. 13 is a side view of a portion of the storage rack of FIG. 1 including a stairway opening.

FIG. 13 illustrates one example of an upright 1300 including an opening 1310. In some examples, the opening 1310 may be sized to accommodate a stairway, doorway, or other environmental component within a warehouse or other storage location. In some examples, the opening 1310 may be framed between the first support post 210 and the second support post 220 of the upright 1300 via one or more vertical braces 1305, which may be secured to the mounting brackets 215, parallel to the first and second support posts 210, 220. Further, due to the modular arrangement of the storage rack 100, the opening 1310 may be sized as desired by a user (e.g., longer vertical braces 1305 may be used for a larger opening 1310, while shorter vertical braces 1305 may be used for a smaller opening 1310). Further, due to the modularity of the mounting bracket 215, the brace assembly 135 may be resumed above or below the opening 1310 via connection to the brackets 215.

Figure 14:
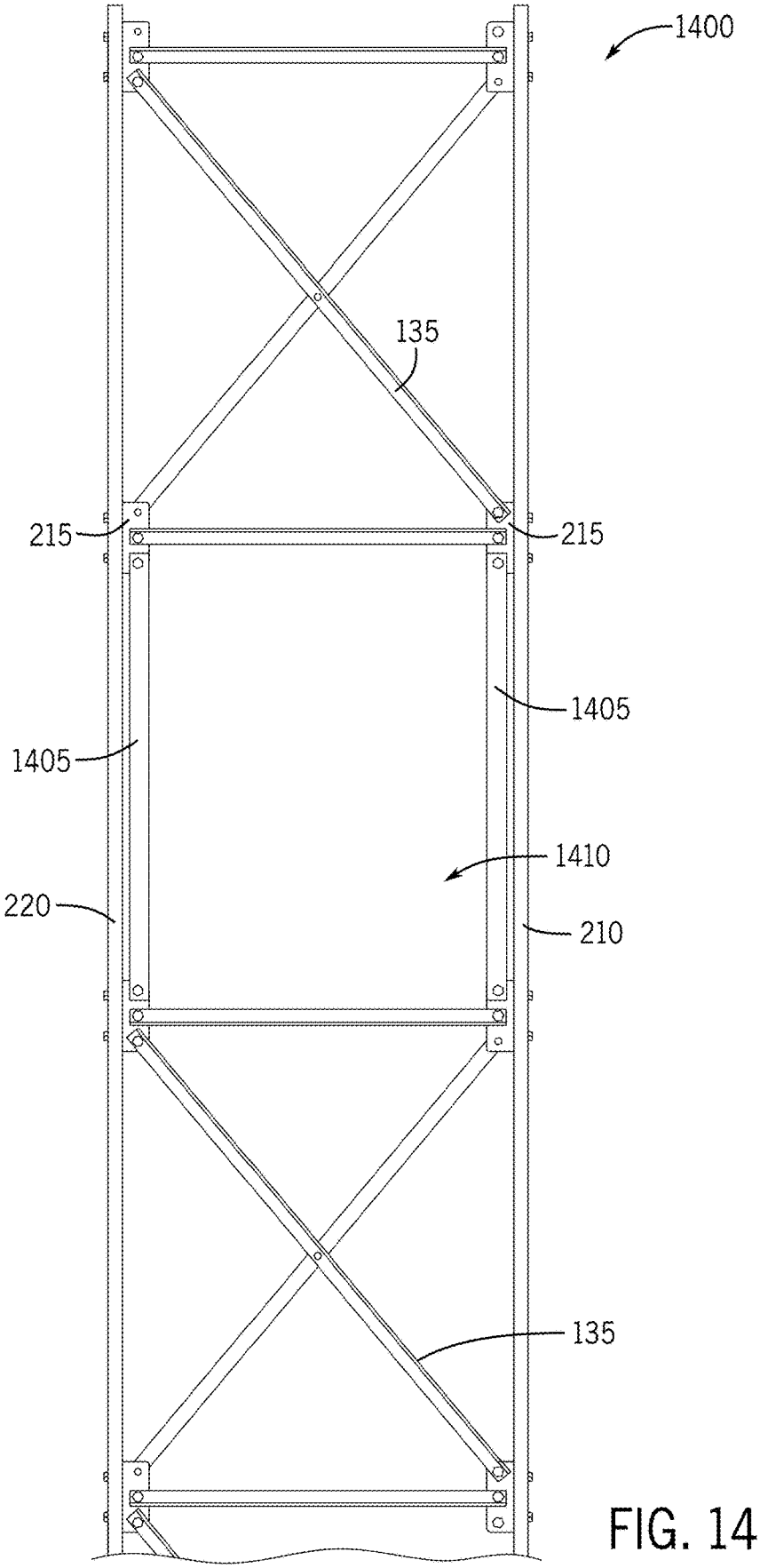
FIG. 14 is a side view of a portion of the storage rack of FIG. 1 including a conveyor opening.

FIG. 14 illustrates another example of an upright 1400 that can be used with the storage rack 100 of FIG. 1 (e.g., as an alternative configuration of the upright 1300). As will be recognized, the upright 1400 shares a number of components in common with and operates in a similar fashion to the examples illustrated and described previously. For the sake of brevity, these common features will not be again described below in detail. Rather, previous discussion of commonly named or numbered features, unless otherwise indicated, also applies to example configurations of the upright 1400.

In some examples, an opening 1410 of the upright 1400 may be sized to accommodate components of an Automated Storage and Retrieval (ASRS) system (e.g., a conveyor, robot, etc.). Thus, the opening 1410 may be positioned between portions of brace assembly 135 of the upright 1400 (or X-braced panels). For example, due to the modularity of the mounting bracket 215, the upright 1400 may transition from brace assembly 135 (e.g., a Z-shaped brace assembly, X-shaped brace assembly, etc.) to having one or more vertical braces 1405 oriented parallel to the first and second support posts 210, 220 (e.g., a framed, rectangular brace assembly), and back to the brace assembly 135. Thus, an operator may position an opening 1410 wherever needed to facilitate the use of the ASRS (or other) system, without needing to cut or otherwise damage the storage rack 100.

Figure 15:
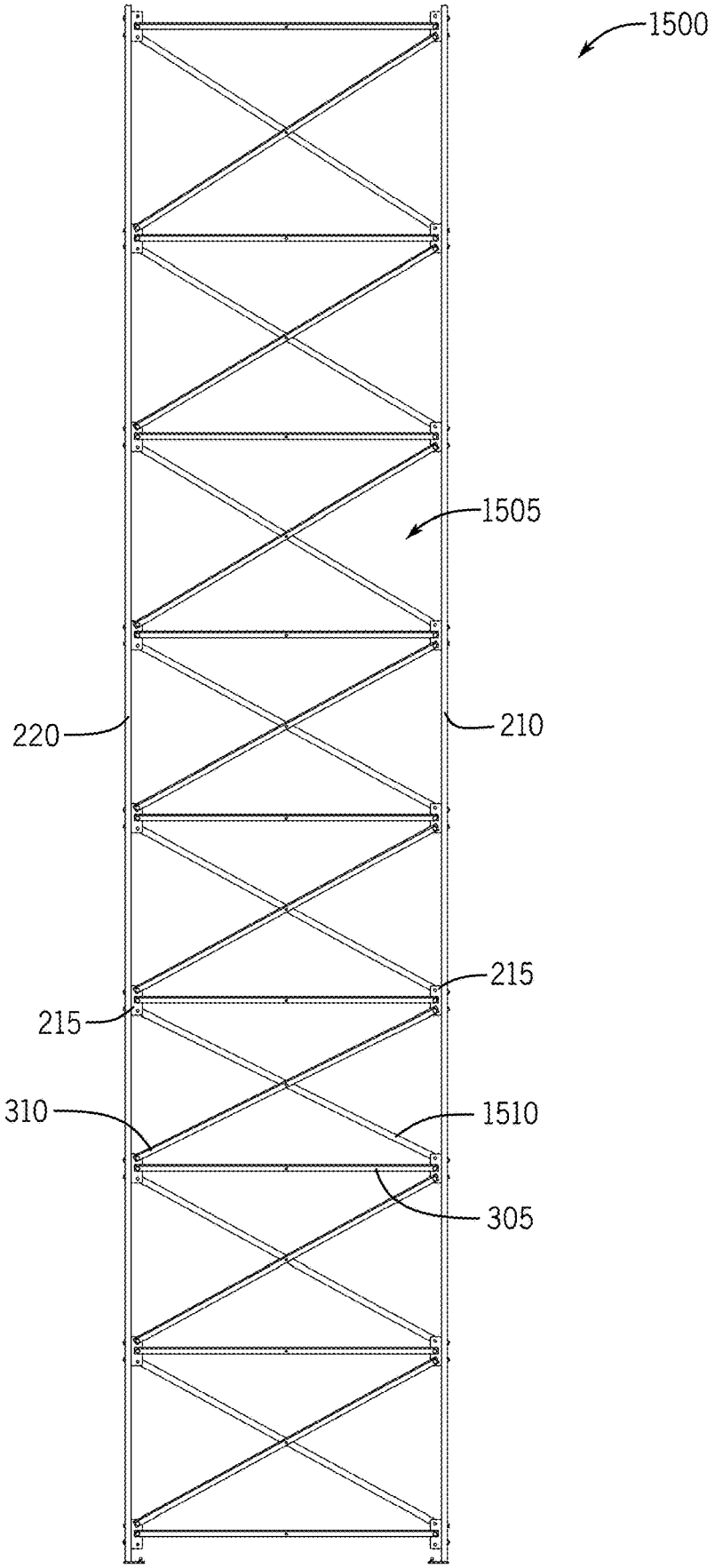
FIG. 15 is a side view of a portion of the storage rack of FIG. 1 including a reinforced brace assembly.

FIG. 15 illustrates another example of an upright 1500 that can be used with the storage rack 100 of FIG. 1 (e.g., as an alternative configuration of the uprights 105). As will be recognized, the upright 1500 shares a number of components in common with and operates in a similar fashion to the examples illustrated and described previously. For the sake of brevity, these common features will not be again described below in detail. Rather, previous discussion of commonly named or numbered features, unless otherwise indicated, also applies to example configurations of the upright 1500.

In some examples, the upright 1500 may include a brace assembly 1505 having the horizontal brace 305, angled brace 310, and a cross-brace 1510, which may extend across the angled brace 310. Put differently, the pattern defined by the brace assembly 1505 may be X-shaped so as to provide tension diagonals in opposing (e.g., left and right) directions. In some examples, via the arrangement of the mounting bracket 215 (e.g., including three thru-holes 430), each of the horizontal brace 305, angled brace 310, and the cross-brace 1510 may be secured to a single mounting bracket 215. As should be appreciated, the brace assembly 1505 may prove useful in applications where the storage rack 100 may be used to hold particularly heavy loads (e.g., metals, etc.) or when in areas of heigh seismic or wind activity.

Figure 16:
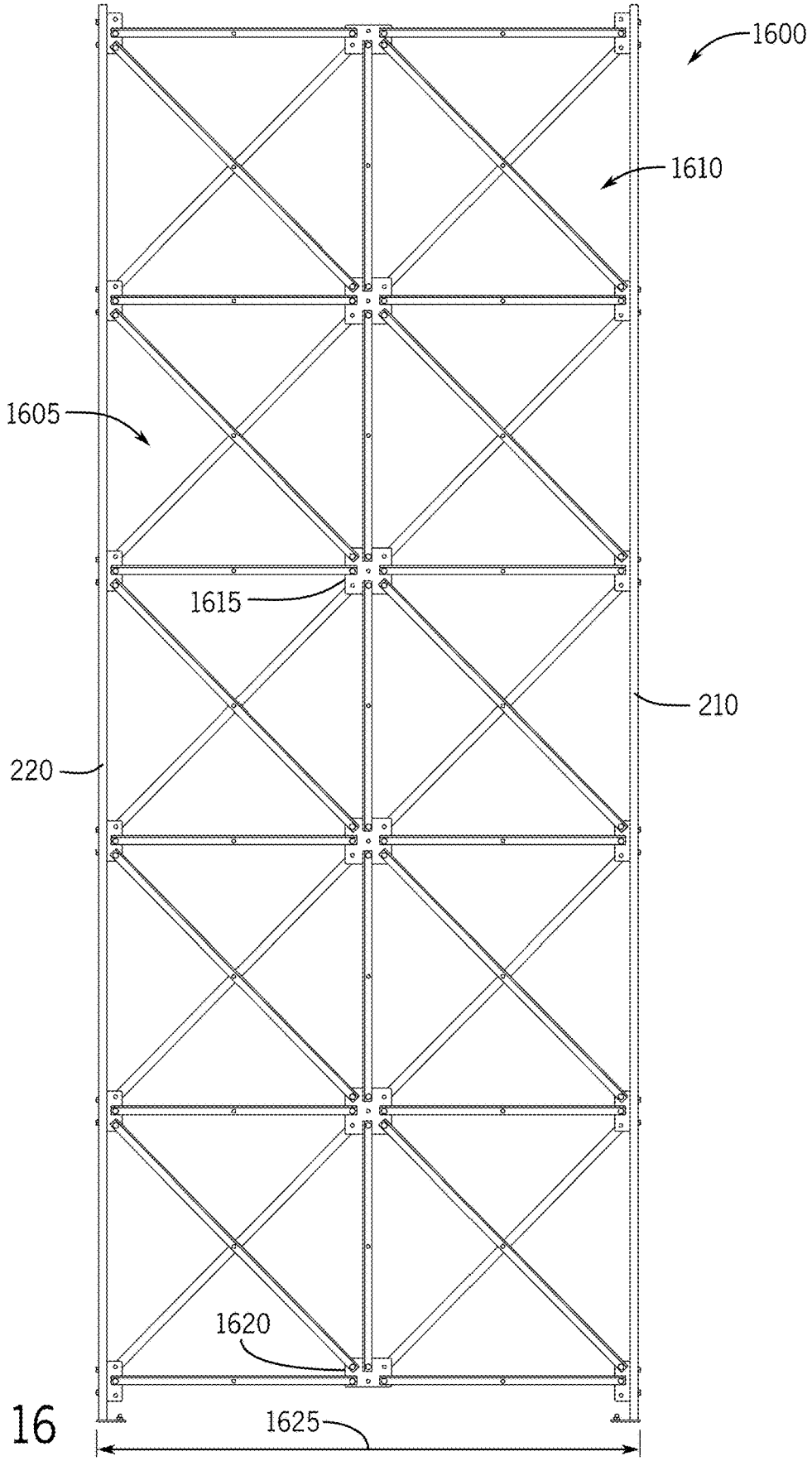
FIG. 16 is a side view of a portion of the storage rack of FIG. 1 including an extended depth brace assembly.
Figure 17:
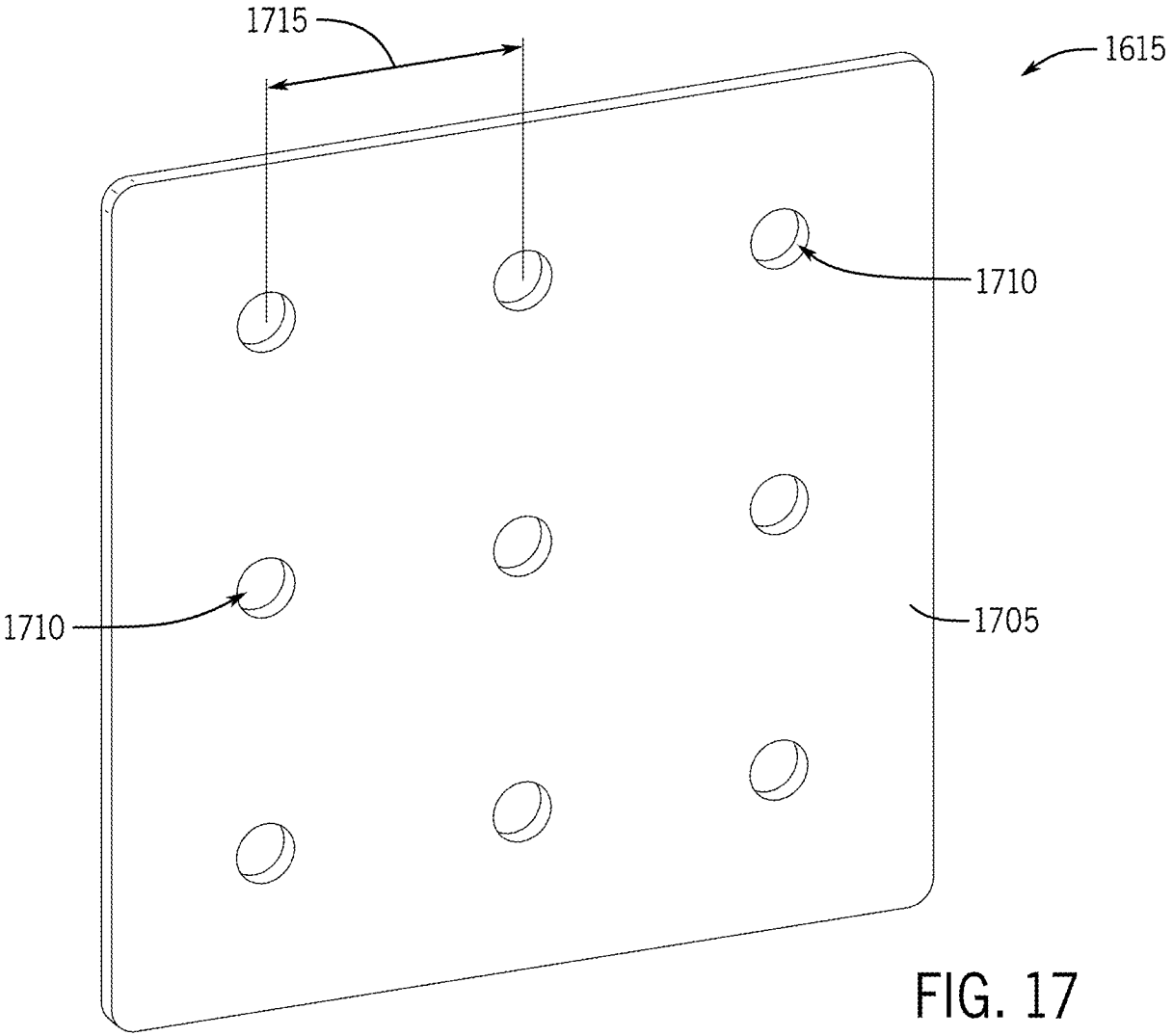
FIG. 17 is an axonometric view of a support plate for use with the extended depth brace assembly of the storage rack of FIG. 16.
Figure 18:
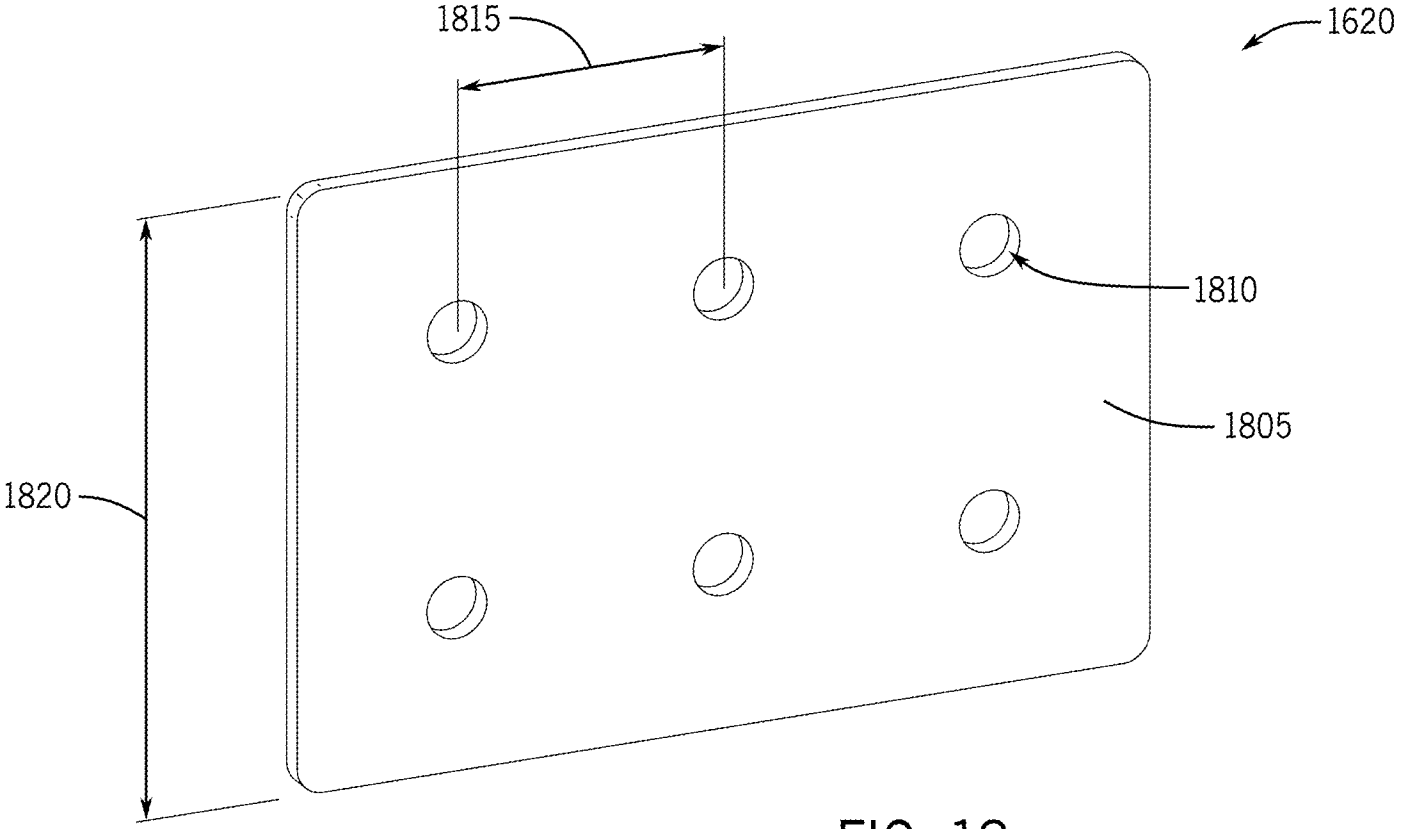
FIG. 18 is an axonometric view of another example of a support plate for use with the extended depth brace assembly of the storage rack of FIG. 16.

FIGS. 16-18 illustrate another example of an upright (e.g., an upright frame) 1600 that can be used with the storage rack 100 of FIG. 1 (e.g., as an alternative configuration of the uprights 105). As will be recognized, the upright 1600 shares a number of components in common with and operates in a similar fashion to the examples illustrated and described previously. For the sake of brevity, these common features will not be again described below in detail. Rather, previous discussion of commonly named or numbered features, unless otherwise indicated, also applies to example configurations of the upright 1600.

In some examples, the upright 1600 may include a depth 1625 that is about double a depth of the uprights (e.g., uprights 105, 1500, etc.) described previously. Thus, the upright 1600 may facilitate the storage of larger (e.g., deeper) products vs. the uprights described previously. In some examples, the upright 1600 may include a first brace assembly (e.g., column of X-shaped braces) 1605 (e.g., any of brace assembly 135, brace assembly 1505, etc.) that may extend from the second support post 220 to a first support plate 1615 or a second support plate 1620, which may be positioned between the second support post 220 and the first support post 210. Further, a corresponding second brace assembly (e.g., column of X-shaped braces) 1610 may extend from the first support plate 1615 or the second support plate 1620 to the first support post 210. Thus, the upright 1600 may include both the first brace assembly 1605 and the second brace assembly 1610, which may extend between the first support post 210 and the second support post 220 via the first support plate 1615, second support plate 1620. In some examples, the first and second brace assemblies 1605, 1610 may be the same or difference brace assemblies, depending on the needs of an operator.

In some examples, the first support plate 1615 may include a body 1705 defining a series of spaced apertures 1710. The apertures 1710 may be designed so that a spacing 1715 of the apertures 1710 matches a corresponding spacing of the thru-holes 430 of the mounting bracket 215. Correspondingly, the second support plate 1620 may include a body 1805 defining a series of spaced apertures 1810. Similar to the first support plate 1615, the apertures 1810 of the second support plate 1620 may be designed so that a spacing 1815 of the apertures 1810 matches both the mounting bracket 215 and the first support plate 1615. Further, the second support plate 1620 may be designed so that a height 1820 of the second support plate 1620 may be about ⅔ a height of the first support plate 1615. Alternatively or additionally, the second support place 1620 may be designed to have about ⅔ the number of apertures as the support place 1615.

Figure 19:
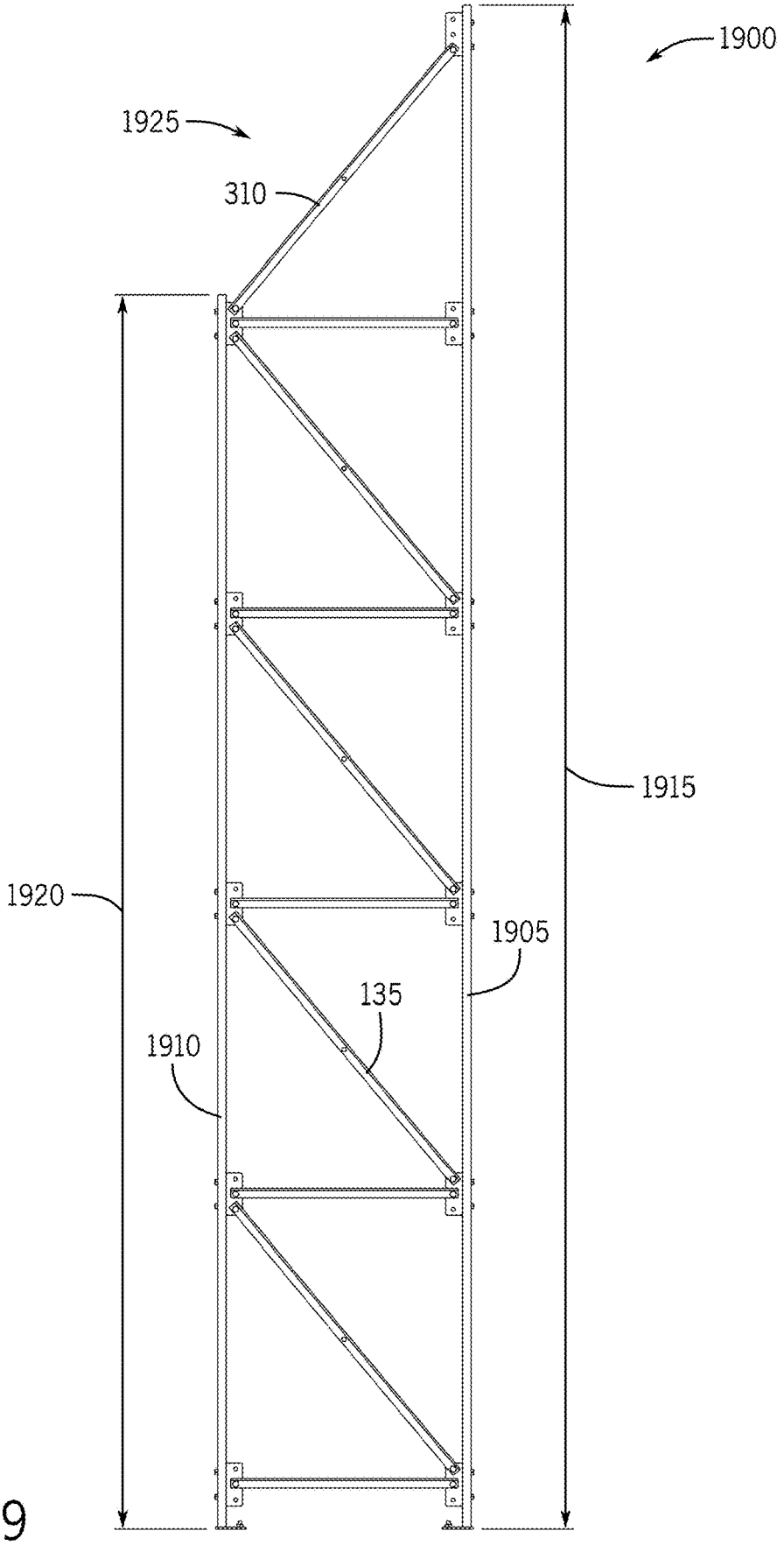
FIG. 19 is a side view of another example of an upright of the storage rack of FIG. 1.

FIG. 19 illustrates another example of an upright 1900 that can be used with the storage rack 100 of FIG. 1 (e.g., as an alternative configuration of the uprights 105). As will be recognized, the upright 1900 shares a number of components in common with and operates in a similar fashion to the examples illustrated and described previously. For the sake of brevity, these common features will not be again described below in detail. Rather, previous discussion of commonly named or numbered features, unless otherwise indicated, also applies to example configurations of the upright 1900.

In some examples, the upright 1900 may include a first post 1905 defining a height 1915 that is taller than a corresponding height 1920 of a second post 1910. Thus, an end 1925 of the upright 1900 may define an angle formed by the angled brace 310 of the brace assembly 135. In some examples, the angled end 1925 of the upright 1900 may permit the use of the upright 1900 in warehouses or other areas having particularly tight space requirements (e.g., to avoid contact with a ceiling, HVAC system, etc.) or for attachment of backside safety netting to prevent accidental dislodgement of produce or other products during operation.

Figure 20:
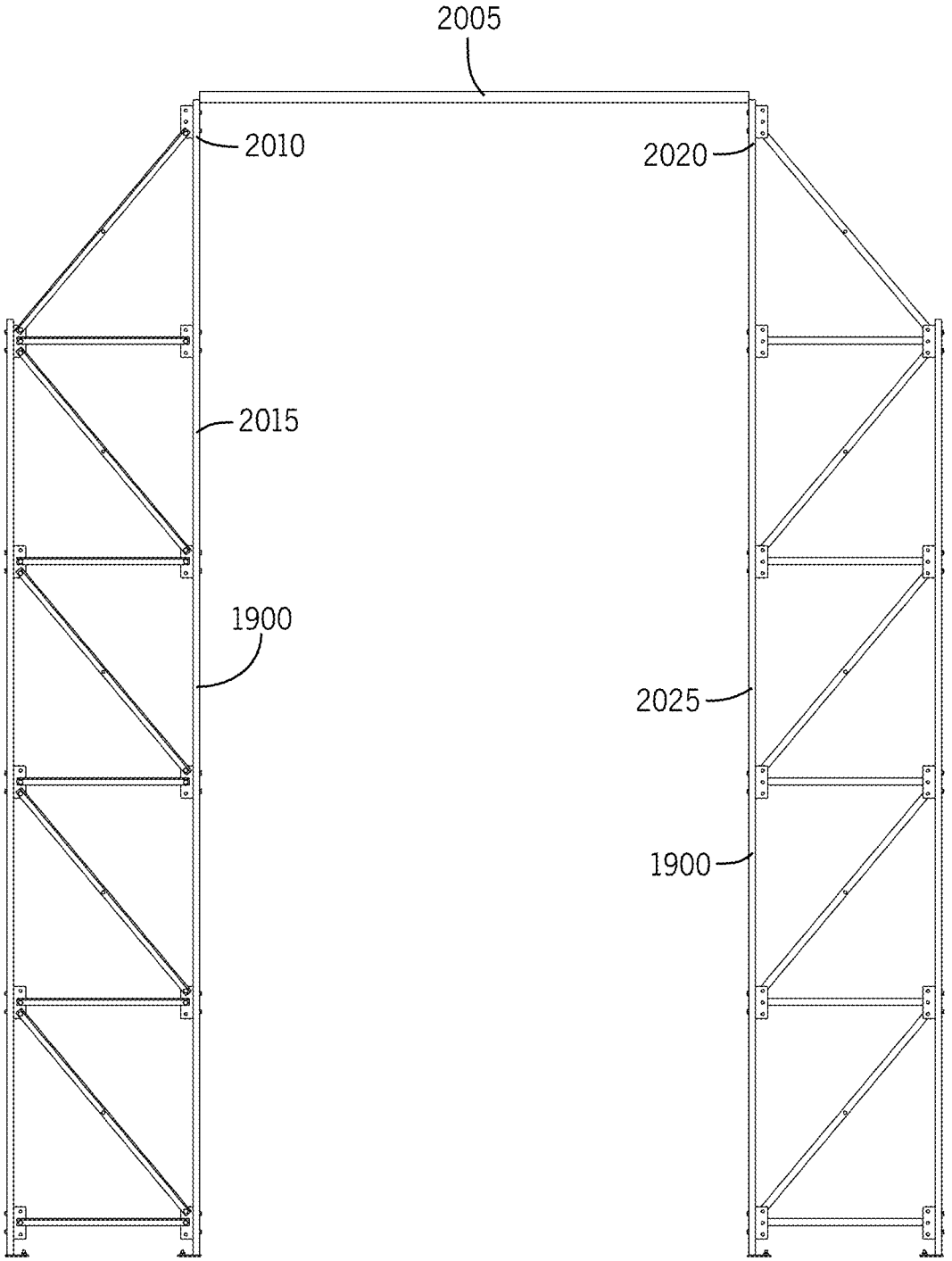
FIG. 20 is a side view of the upright of the storage rack of FIG. 19, tied together using a cross-aisle tie, forming an ASRS framed system.

In another example as shown in FIG. 20, the upright 1900 may be used along with a bridge (e.g., a cross-aisle tie) 2005 to facilitate the use of an ASRS system with the storage rack 100. For example, the bridge 2005 may be secured between an apex 2010 of a first upright 2015 and an apex 2020 of a second upright 2025, which may permit components of an ASRS system (e.g., a robot, conveyor, automated crane, etc.) to travel between the first upright 2015 and the second upright 2025 or to travel in and out of aisles between rows of the storage rack 100 (e.g., to facilitate automated item storage or retrieval).

Figure 21:
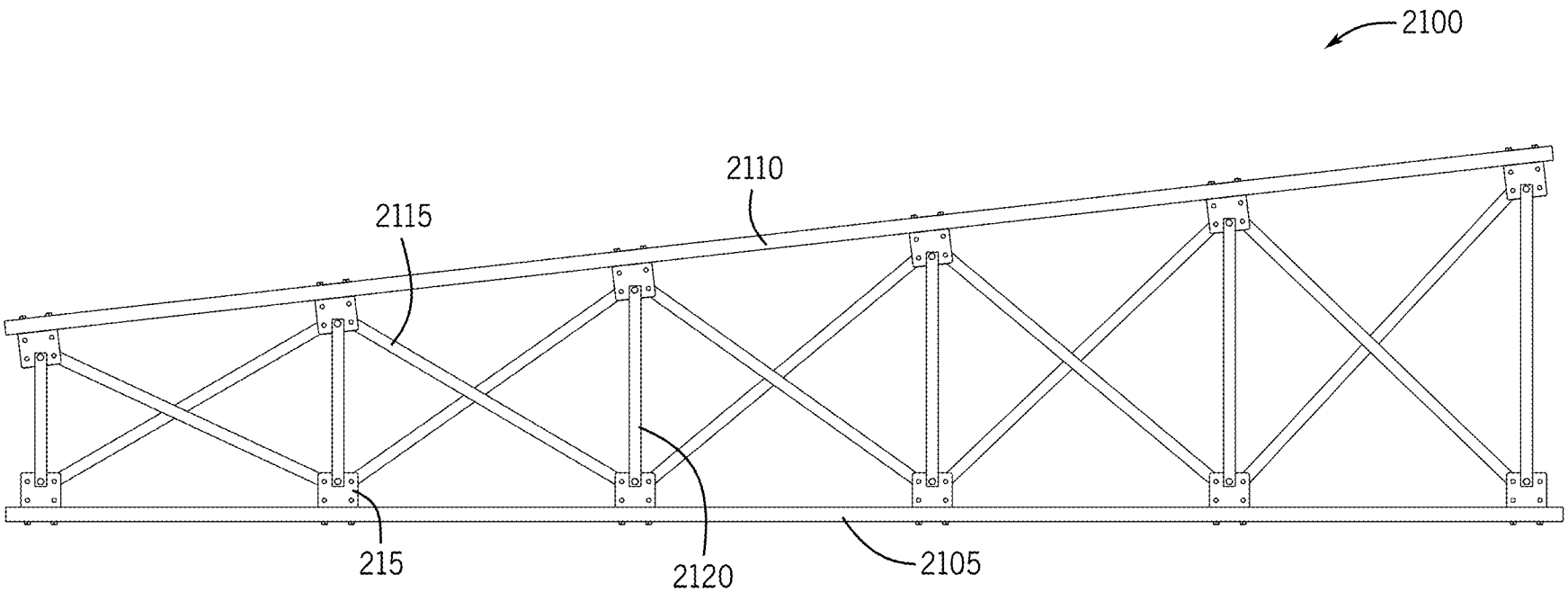
FIG. 21 is side view of a truss for use with the storage rack of FIG. 1, for rack supported buildings.
Figure 22:
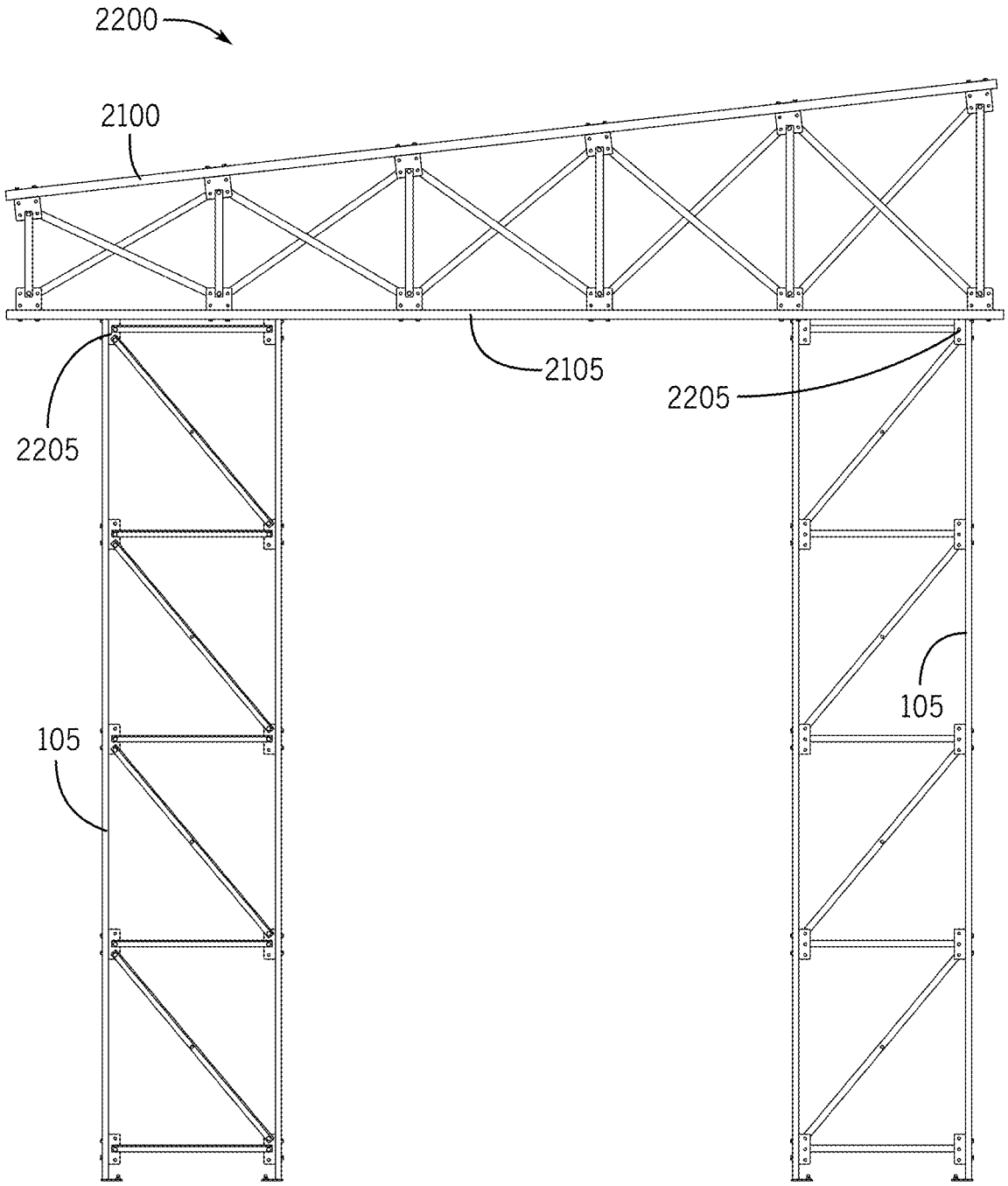
FIG. 22 is a side view of a truss assembly including the storage rack of FIG. 1 and the truss of FIG. 21.

FIGS. 21 and 22 show examples of a truss (e.g., a room truss) assembly utilizing the uprights of the storage rack 100 to support a building structure (e.g., a "rack-supported building"). In some examples, the uprights 105 may be modified to create a truss 2100 (e.g., to support the roof of a warehouse, etc.), which may be directly mounted to an end 2205 of the uprights. In some examples, the truss 2100 may include a first chord 2105 and a second chord 2110, which may be separated by one or more angled braces 2115 secured to the one or more mounting brackets 215. In some examples, in order to adjust a pitch (e.g., angle or slope of the chord 2110) of the truss 2100, a height of one or more vertical braces 2120 may be incrementally increases from one end of the chords 2105, 2110 to another, opposite end of the chords 2105, 2110 (e.g., as shown in FIG. 21). Thus, via the selection of the vertical braces 2120 the desired pitch of the truss 2100 (e.g., the top chord 2110) may be created. As should be appreciated, the use of the mounting brackets 215 may permit an operator to modify a pitch of the truss 2100 by replacing the vertical braces 2120 with one or more vertical braces 2120 of a different length. Thus, a modular truss 2100 may be facilitated.

In some implementations, devices or systems disclosed herein can be utilized, manufactured, or installed using methods embodying aspects of the invention. Correspondingly, any description herein of particular features, capabilities, or intended purposes of a device or system is generally intended to include disclosure of a method of using such devices for the intended purposes, a method of otherwise implementing such capabilities, a method of manufacturing relevant components of such a device or system (or the device or system as a whole), and a method of installing disclosed (or otherwise known) components to support such purposes or capabilities. Similarly, unless otherwise indicated or limited, discussion herein of any method of manufacturing or using for a particular device or system, including installing the device or system, is intended to inherently include disclosure, as embodiments of the invention, of the utilized features and implemented capabilities of such device or system.

Also as used herein, unless otherwise limited or defined, "or" indicates a non-exclusive list of components or operations that can be present in any variety of combinations, rather than an exclusive list of components that can be present only as alternatives to each other. For example, a list of "A, B, or C" indicates options of: A; B; C; A and B; A and C; B and C; and A, B, and C. Correspondingly, the term "or" as used herein is intended to indicate exclusive alternatives only when preceded by terms of exclusivity, such as "either," "one of," "only one of," or "exactly one of." For example, a list of "one of A, B, or C" indicates options of: A, but not B and C; B, but not A and C; and C, but not A and B. A list preceded by "one or more" (and variations thereon) and including "or" to separate listed elements indicates options of one or more of any or all of the listed elements. For example, the phrases "one or more of A, B, or C" and "at least one of A, B, or C" indicate options of: one or more A; one or more B; one or more C; one or more A and one or more B; one or more B and one or more C; one or more A and one or more C; and one or more of A, one or more of B, and one or more of C. Similarly, a list preceded by "a plurality of" (and variations thereon) and including "or" to separate listed elements indicates options of multiple instances of any or all of the listed elements. For example, the phrases "a plurality of A, B, or C" and "two or more of A, B, or C"indicate options of: A and B; B and C; A and C; and A, B, and C.

As used herein, unless otherwise defined or limited, directional terms are used for convenience of reference for discussion of particular figures or examples. For example, references to downward (or other) directions or top (or other) positions may be used to discuss aspects of a particular example or figure, but do not necessarily require similar orientation or geometry in all installations or configurations.

Also as used herein, unless otherwise limited or defined, "substantially parallel" indicates a direction that is within ±12 degrees of a reference direction (e.g., within ±6 degrees), inclusive.

Also as used herein, unless otherwise limited or defined, "substantially perpendicular" indicates a direction that is within ±12 degrees of perpendicular a reference direction (e.g., within ±6 degrees), inclusive.

Also as used herein, unless otherwise limited or defined, "integral" and derivatives thereof (e.g., "integrally") describe elements that are manufactured as a single piece without fasteners, adhesive, or the like to secure separate components together. For example, an element stamped, cast, or otherwise molded as a single-piece component from a single piece of sheet metal or using a single mold, without rivets, screws, or adhesive to hold separately formed pieces together is an integral (and integrally formed) element. In contrast, an element formed from multiple pieces that are separately formed initially then later connected together, is not an integral (or integrally formed) element.

Additionally, unless otherwise specified or limited, the terms "about" and "approximately," as used herein with respect to a reference value, refer to variations from the reference value of ±15% or less, inclusive of the endpoints of the range. Similarly, the term "substantially equal" (and the like) as used herein with respect to a reference value refers to variations from the reference value of less than ±10%, inclusive. Where specified, "substantially" can indicate in particular a variation in one numerical direction relative to a reference value. For example, "substantially less" than a reference value (and the like) indicates a value that is reduced from the reference value by 10% or more, and "substantially more" than a reference value (and the like) indicates a value that is increased from the reference value by 10% or more.

Also as used herein, unless otherwise limited or specified, "substantially identical" refers to two or more components or systems that are manufactured or used according to the same process and specification, with variation between the components or systems that are within the limitations of acceptable tolerances for the relevant process and specification. For example, two components can be considered to be substantially identical if the components are manufactured according to the same standardized manufacturing steps, with the same materials, and within the same acceptable dimensional tolerances (e.g., as specified for a particular process or product).

Unless otherwise specifically indicated, ordinal numbers are used herein for convenience of reference, based generally on the order in which particular components are presented in the relevant part of the disclosure. In this regard, for example, designations such as "first," "second," etc., generally indicate only the order in which a thus-labeled component is introduced for discussion and generally do not indicate or require a particular spatial, functional, temporal, or structural primacy or order.

The previous description of the disclosed embodiments is provided to enable any person skilled in the art to make or use the invention. Given the benefit of this disclosure, various modifications to these embodiments will be readily apparent to those skilled in the art, and the principles defined herein may be applied to other embodiments without departing from the spirit or scope of the invention. Thus, the invention is not intended to be limited to the embodiments shown herein but is to be accorded the widest scope consistent with the principles and novel features disclosed herein.

What is claimed is:

1. A hot rolled storage rack, comprising:

a first hot rolled support post, the first hot rolled support post including a first leg and a second leg secured together via a splice assembly, the splice assembly including:

a first plate, the first plate arranged on a first side of the first hot rolled support post;

a reinforcement post arranged on a second, opposite side of the first hot rolled support post;

a first fastener arranged through the first plate, the first leg, and the reinforcement post of the first hot rolled support post; and a second fastener arranged through the first plate, the second leg, and the reinforcement post of the first hot rolled support post;

wherein the splice assembly permits replacement of the first leg of the first hot rolled support post without replacement of the second leg of the first hot rolled support post;

a second hot rolled support post;

a bracket, the bracket secured to the first hot rolled support post; and a brace assembly to secure the first hot rolled support post to the second hot rolled support post, the brace assembly arranged between the first hot rolled support post and the second hot rolled support post and secured to the first hot rolled support post via the bracket.

2. The hot rolled storage rack of claim 1, wherein the reinforcement post and the first leg of the first hot rolled support post together form a double-thickness portion of the first hot rolled support post.

3. The hot rolled storage rack of claim 1, further comprising:

a third hot rolled support post;

a fourth hot rolled support post;

a first crossmember extending from the first hot rolled support post to the third hot rolled support post; and a second crossmember extending from the second hot rolled support post to the fourth hot rolled support post.

4. The hot rolled storage rack of claim 1, wherein the bracket includes:

a first L-shaped portion; and a second L-shaped portion, separate from the first L-shaped portion.

5. The hot rolled storage rack of claim 4, wherein the first L-shaped portion includes a first flange defining a thru-hole, the first flange to receive a fastener arranged through the thru-hole to secure the first L-shaped portion to the first support post.

6. The hot rolled storage rack of claim 5, wherein the first L-shaped portion includes a second flange, the second flange extending perpendicularly away from the first flange and defining a thru-hole, the second flange to receive a fastener arranged through the thru-hole to secure the brace assembly to the first L-shaped portion.

7. The hot rolled storage rack of claim 1, wherein the brace assembly includes a series of braces forming a Z-shaped pattern extending between the first hot rolled support post and the second hot rolled support post, the braces secured to the first hot rolled support post and the second hot rolled support post via the brackets.

8. The hot rolled storage rack of claim 1, wherein the brace assembly includes a series of braces forming a rectangular opening extending between the first hot rolled support post and the second hot rolled support post, the braces secured to the first hot rolled support post and the second hot rolled support post via the brackets.

9. The hot rolled storage rack of claim 1, wherein the brace assembly includes a series of braces forming an X-shaped pattern extending between the first hot rolled support post and the second hot rolled support post, the braces secured to the first hot rolled support post and the second hot rolled support post via the brackets.

10. The hot rolled storage rack of claim 1, wherein the first hot rolled support post and the second hot rolled post are different heights.

11. The hot rolled storage rack of claim 1, further comprising:

an offset leg assembly, including:

a double-thickness leg, the double-thickness leg offset from the first hot rolled support post, between the first hot rolled support post and the second hot rolled support post; and a strut, the strut arranged between the first hot rolled support post and the second hot rolled support post and secured via the brackets, and the strut including a first portion and a separate second portion; and a gusset, a first end of the gusset secured to the double-thickness leg and a second end of the gusset arranged between the first and second portions of the strut.

12. The hot rolled storage rack of claim 11, wherein the second end of the gusset is secured to the strut via a fastener arranged through the first portion of the strut, the gusset, and the second portion of the strut.

13. The hot rolled storage rack of claim 6, wherein the brace assembly includes a support plate arranged between the first hot rolled support post and the second hot rolled support post, and wherein the support plate defines a series of equally-spaced apertures, the apertures matching a spacing of the thru-holes of the brackets.

14. The hot rolled storage rack of claim 1, wherein the reinforcement post extends from a first end of the first leg of the first hot rolled support post past a separation between the first leg and the second leg of the first hot rolled support post.

15. The hot rolled storage rack of claim 14, wherein the reinforcement post extends at least 6 inches past the separation between the first leg and the second leg of the first hot rolled support post.

16. The hot rolled storage rack of claim 14, wherein the first end of the first leg of the first hot rolled support post is adjacent to a ground surface.

17. The hot rolled storage rack of claim 1, wherein the second leg of the first hot rolled support post is sandwiched between the first plate and the reinforcement post.

18. The hot rolled storage rack of claim 1, wherein the splice assembly further includes a shelf arranged between a second end of the first leg and a first end of the second leg.

19. The hot rolled storage rack of claim 18, wherein the shelf is secured to a face of the reinforcement post, and wherein the shelf extends away from the face of the reinforcement post towards the first leg and the second leg of the first hot rolled support post.

* * * * *